US006499329B1

(12) United States Patent
Enoki et al.

(10) Patent No.: US 6,499,329 B1
(45) Date of Patent: Dec. 31, 2002

(54) PRODUCTION METHOD FOR BOTTLE TYPE CAN AND FORM-WORKING TOOL

(75) Inventors: Yasushi Enoki; Yukio Ogawa; Satoru Moriya, all of Sagamihara (JP)

(73) Assignee: Daiwa Can Company, Tokyo (JP)

( * ) Notice: Subject to any disclaimer, the term of this patent is extended or adjusted under 35 U.S.C. 154(b) by 0 days.

(21) Appl. No.: 09/830,671

(22) PCT Filed: Aug. 24, 2000

(86) PCT No.: PCT/JP00/05717

§ 371 (c)(1),
(2), (4) Date: Apr. 30, 2001

(87) PCT Pub. No.: WO01/15829

PCT Pub. Date: Mar. 8, 2001

(30) Foreign Application Priority Data

Aug. 30, 1999 (JP) ..... 11-242495

(51) Int. Cl.[7] ..... B21D 22/28
(52) U.S. Cl. ..... 72/348; 72/356
(58) Field of Search ..... 72/46, 348, 356, 72/379.4

(56) References Cited

U.S. PATENT DOCUMENTS

| | | | |
|---|---|---|---|
| 2,359,775 | A | 10/1944 | McManus et al. |
| 3,924,437 | A | 12/1975 | Hortig |
| 5,718,352 | A | 2/1998 | Diekhoff et al |
| 5,822,843 | A | 10/1998 | Diekhoff et al. |
| 6,010,026 | A | 1/2000 | Diekhoff et al. |
| 6,010,028 | A | 1/2000 | Jordan et al. |

FOREIGN PATENT DOCUMENTS

| | | |
|---|---|---|
| JP | 55-107638 | 8/1980 |
| JP | 59-115239 | 7/1984 |
| JP | 64-62233 | 3/1989 |
| JP | 1-210136 | 8/1989 |
| JP | 10-509095 | 9/1998 |
| JP | 11-139438 | 5/1999 |
| JP | 2000-190042 | 7/2000 |

*Primary Examiner*—Lowell A. Larson
(74) *Attorney, Agent, or Firm*—Oblon, Spivak, McClelland, Maier & Neustadt, P.C.

(57) ABSTRACT

A bottle-shaped can manufacturing method for forming a shoulder portion having a slope and a diametrically small cylindrical neck portion integrally by further working a bottom side of a bottomed cylindrical can which is formed thinner at its trunk wall than at its bottom wall by drawing a metallic sheet having a thickness of 0.1 to 0.4 mm and by executing at least one thinning working of a bending/extending working and an ironing working. This method comprises: a step of preforming a bottom corner portion of the can into a curved shoulder face having an arcuate longitudinal section; a first diametrically small cylindrical portion forming step of drawing the bottom of the can into a diametrically smaller bottomed cylindrical shape than the trunk portion, with the curved shoulder face of the bottom corner portion being unwrinkled; a second diametrically small cylindrical portion forming step of drawing the bottomed cylindrical portion drawn from the can bottom into a diametrically smaller bottomed cylindrical shape, with the bottom corner portion being unwrinkled by the surface of a tool; and a shoulder portion reforming step of pushing and extending the shoulder portion, which is formed by the first diametrically small cylindrical portion forming step and the second diametrically small cylindrical portion forming step into a smooth slope leading to the curved shoulder face on the trunk side, after the diameter of the bottomed cylindrical portion formed by executing the drawing working of the second diametrically small cylindrical portion forming step once or two or more times becomes substantially equal to a diameter of the neck portion.

16 Claims, 13 Drawing Sheets

PRODUCTION METHOD FOR BOTTLE TYPE CAN AND FORM-WORKING TOOL

TECHNICAL FIELD

The present invention relates to a method for manufacturing a bottle-shaped can, of which a can trunk, a shoulder portion and a neck portion having a threaded portion are integrally formed, of a metallic sheet having a thickness of 0.1 to 0.4 mm, and a tool for use in the method.

More particularly, the invention relates to a forming method for forming especially the shoulder portion into a smooth and beautiful slope not in a step shape or a shape having a step mark left, when the bottle-shaped can is to be manufactured by working the bottom side of the can formed into a bottomed cylindrical shape, to form the shoulder portion having an inclined annular face and a diametrically small cylindrical neck portion integrally, and a tool for use in the method.

BACKGROUND ART

As beverage cans for various soft drinks or beer, there are generally employed the DI cans (Drawn and Ironed cans), of which the can trunk (or side wall portion) and the can bottom are integrally formed by drawing and ironing a metallic sheet such as an aluminum alloy sheet or a surface-treated steel sheet.

Specifically, this DI can has its body formed by integrally forming the bottom portion having a shape of a high pressure resistance and a trunk portion thinned by the drawing and ironing workings and by necking in the open upper end of the trunk portion to reduce a diameter of the open upper end. The can body is filled with a drink such as a soft drink or beer, and the diametrically reduced open upper end is seamed with an easy open end (i.e., an end sheet having an easy opening) having a smaller diameter than that of the trunk. These cans are shipped as canned drinks.

As disclosed in WO 81/01259, on the other hand, there is also practiced the bottomed cylindrical can which is formed to have a thinner trunk wall than a bottom wall by drawing and re-drawing (or bending and extending at the re-drawing time) the surface-treated steel sheet laminated on its two sides with a thermoplastic resin film. The can thus manufactured is necked in like the DI can so that it may be used as the beverage can.

As the containers for various soft drinks, on the other hand, there have been employed in recent years the bi-oriented molded container made of a polyethylene terephthalate resin (i.e., the PET bottle). Accordingly, there have been manufactured various beverages contained in the PET bottles which can be repeatedly sealed with threaded caps.

These beverage PET bottles have an advantage over the above-described can containers for beverages in that the PET bottles can be repeatedly sealed with the caps. However, the PET bottles are in considerably lower states than those of the can containers in the recycling ratio for collecting and recycling the resources. Therefore, it has been investigated to enhance the conveniences of the can containers by adding re-sealing function to the can containers having the high resource recycling ratio.

In the prior art, there are disclosed in Japanese Patent Laid-Open No. 10-509095 (WO96/15865) several types of bottle-type DI cans having shapes similar to those of the PET bottles, i.e., the DI cans which have threaded neck portions to be screwed and closed with the threaded caps.

These DI cans are classified into: the type in which an end sheet to be seamed on the open upper end of a can trunk is formed integrally with a threaded neck portion; the type in which the threaded neck portion is integrally formed by reducing the diameter of the open upper end side of the can trunk stepwise by the neck-in working; and the type in which the diametrically small neck portion and the shoulder portion having a slope are formed by drawing the bottom portion side (or the end wall portion) of a cup at multiple steps, in which the trunk portion of the cup is then ironed into a thin trunk portion and in which a threaded portion is formed in the neck portion whereas the can end is seamed on the open end of the trunk portion. In the above-specified Laid-Open, there are disclosed not only the structures of the bottle-shaped cans of the individual types but also the forming methods.

According to the disclosure of Japanese Patent Laid-Open No. 58-47520, on the other hand, at the time of drawing the can trunk, the bottom portion is drawn into a convex stepped shape, and this convex stepped shape is re-drawn at a subsequent ironing time, to form a convex stepped portion having a diametrically small cylindrical neck portion and a square shoulder portion in the bottom portion (or the end wall portion) of the DI can. This neck portion is threaded and sealed with the threaded cap. After this DI can was filled with beverage from the end opening of the trunk portion, this end opening is sealed by seaming the can end.

In Japanese Patent Laid-Open No. 64-62233, moreover, there is disclosed that the DI can drawn and ironed is pressed (or drawn) at its bottom to form a diametrically small cylindrical neck portion and a frusto-conical shoulder portion (having a shape of a frustum of a cone) and that a thread is then formed in or a threaded cylindrical portion is mounted on the neck portion.

Of the aforementioned bottle-shaped cans which can be sealed again with the threaded cap, the can of the type in which the threaded neck portion is formed integrally with the end sheet is formed at its body into the DI can or a bottomed can such as the DTRD can (Drawn, Thin and Re-Drawn) formed by being drawn and bent/extended (or stretched) or the can formed by being bent/extended (or stretched) and ironed. The can trunk is filled with a content such as beverage, and then the open upper end of the can trunk is seamed and sealed with the end sheet having the threaded neck portion formed integrally therewith. According to the bottle-shaped can of this type, therefore, the can body has a shape substantially identical to that of the existing general can, and enjoys an advantage that few changes are required in the filling facilities to suppress the cost for the facilities.

In the bottle-shaped can of this type, however, the end sheet seaming portion is located in the upper portion of the can to raise problems that dust is liable to accumulate in the concave portion inside of the seamed portion, and that the seamed portion itself protrudes to deteriorate the appearance.

In the bottle-shaped can of the type in which the neck portion is formed not at the end sheet but integrally at the upper end portion of the can body, on the other hand, the upper end portion is stretched thin by a similar working as the can body is drawn and ironed or bent and extended. Considering the later step of working the neck portion, therefore, the upper end portion of the can body may be worked so relatively thick as to make the extension of the material less than the lower portion. Since the neck portion has a considerably smaller diameter than that of the can body, however, the diametrical reduction ratio for forming the neck portion is so large that the neck portion is difficult to constrict all at once by enlarging one drawing rate. In addition, it is desirable to reduce the cap size so as to lower the cost for the material and accordingly to reduce the diameter of the neck portion more than the external diameter of the can body. In order to satisfy these desires, it is necessary to make the diametrical reduction ratio more for forming the neck portion by drawing the open upper end of the can body, and this necessity requires multiple steps of neck-in workings.

For example, the can to be relatively frequently used as the drink can for beer has a trunk diameter of 66 mm (of 211 diameter), and twenty to thirty necking steps are required if the neck portion of such can is to be necked in to a diameter of 25.4 mm. Thus, in the bottle-shaped can having the neck portion formed by constricting the open upper end of the can body, a number of necking machines are required to raise the cost for the facilities, and the increase in the number of working steps makes it frequent to damage or deform the can thereby to lower the quality of the can.

In the bottle-shaped can of the type in which the shoulder portion and the neck portion are formed by working the can bottom, on the contrary, the can bottom portion or the portion to be formed into a portion of the shoulder portion and the neck portion is hardly affected by the working to form the can so that the working is applied to the portion having no work hardening and having a thickness substantially equal to that of the original metallic sheet. When the can bottom is to be drawn, moreover, its diameter can be reduced while being unwrinkled. As compared with the case in which the neck portion is formed by necking in the upper portion of the aforementioned can trunk, therefore, one drawing extent can be increased to reduce the diameter more by one step thereby to reduce the number of steps drastically for forming the neck portion.

Although one drawing extent can be made larger than that of the neck-in working, however, there is a limit to the drawing ratio (i.e., the reduction ratio of one drawing extent). The limit of the drawing ratio in the drawing case with the unwrinkling function is more or less different for the materials and is about 1.5 for a beverage can of a metallic sheet such as a beer can. When a neck portion (having diameter of 25.4 mm) of a diametrically small cylindrical shape is formed by drawing the flat bottom of the bottomed cylindrical DI can (having a diameter of 66 mm), it is necessary to repeat the drawing step three or four times.

As a method for forming the diametrically small neck portion integrally with the bottom side of the DI can, there has been disclosed in Japanese Patent Laid-Open No. 58-47520 a method for manufacturing the DI can having a diameter of 67.83 mm and made of a tinned steel sheet. At a re-drawing step, the bottom portion of the can is re-drawn to form a convex stepped portion having a diameter of 26 mm. This convex stepped portion of the can bottom is re-drawn at the final stroke of the subsequent ironing step, to form the shoulder portion having the so-called "square shouldered portions" and the cylindrical neck portion having a height of 6 mm and a diameter of 16 mm.

In Japanese Patent Laid-Open No. 64-62233, there is disclosed a method for forming a frusto-conical shoulder portion and a cylindrical neck portion by pressing (or drawing) the bottom of the DI can formed into the bottomed cylindrical shape.

According to the former method, however, the height of the neck portion is too short at 6 mm to form a threaded portion capable of retaining sufficient sealing properties. According to the latter method, although the drawing step of multiple stages is not shown in the Drawings of the Specification, it is apparent from FIGS. 2 and 3 that the can trunk has a thickness of two to three times of that of the bottom end, and it is understood from the description of the Specification anticipating the threading of the neck portion that a relatively thick (e.g., about 0.6 to 1.5 mm) aluminum alloy sheet or stainless steel sheet is employed as the trunk material. When this thick material is employed, less wrinkles are formed by the drawing even at a high drawing ratio. Even if so, many drawing steps have to be repeated for forming the diametrically small cylindrical neck portion and the frusto-conical shoulder portion (or a truncated conical shoulder portion). Although the wrinkling can be suppressed, therefore, step shapes or many circumferential marks according to the number of drawing steps are left on the shoulder portion. These step shapes are identical to a plurality of convex and concave steps or ribs, as shown in FIG. 28 of Japanese Patent Laid-Open No. 10-509095, or a plurality of convex and concave steps or circumferential beads 108 shown in FIG. 32.

Here, the problems of the step shapes at the multiple drawing steps by the pressing or the circular shock marks formed when those step shapes are smoothed are described, as follows, in Japanese Patent Laid-Open No. 55-107638 disclosing a method for manufacturing a cup-shaped end for small-sized beer bottles.

In the prior art, after the multiple drawing steps for drawing the can end into a cup shape, a stretching (or a final forming) is performed to finish the end into a predetermined smooth cup shape and to size the cover. By the multiple pre-drawing steps in these working steps, a plurality of a concentric and annular convex portions are formed on the outer face of the cup-shaped end body. These are the portions which are formed by the outer circumference edges of the leading end of a punch having different diameters. These annular convex portions have to be turned backward of their warped direction so that they may be eliminated. In this case, the surface structure of the material, as once extended, receives an inverse compression stress so that the aforementioned shock marks are formed to lower the commercial value seriously.

These shock marks look like streaks not only to degrade the appearance but also to lower the corrosion resistance. On the other hand, the shock marks also occur on the inner face of the end body to separate the coating and cause the corrosion at the shock marks when the material is exemplified by the aluminum alloy sheet having the coating of an epoxy resin on the inner and outer faces, so that the can is unsuited as the can for confining food. When the aluminum alloy sheet is employed for the food can, therefore, the can has to be surface-treated, after pressed, by oxidizing or coating it so that an increase in cost cannot be avoided.

In the invention disclosed in Japanese Patent Laid-Open No. 55-107638, therefore, it is intended to prevent the shock marks from appearing, by leaving the annular convex and concave portions formed by the multiple drawing steps on the cup-shaped end body.

If these annular convex and concave portions are on the upper face of the container, however, it cannot be said that the appearance is excellent. In the container of this shape, on the other hand, dust is liable to accumulate in the concave portions while the container is displayed in the shop and cannot be easily wiped off, to raise a problem that the appearance is degraded.

By repeating the drawing of the flat bottom of the DI can three or four times, as described before, the diametrically small cylindrical neck portion and the shoulder portion having the slope can be formed integrally with the can body, to provide a bottle-shaped can having a shape resembling the PET bottle having a round transverse section, as employed as the ordinary beverage container. At the individual drawing steps of the forming steps, the unwrinkling has to be performed with individual tools. Therefore, the ring-shaped and the step-shaped portions corresponding to the shape of the inner circumference end edges of the drawing die are so formed at the portion or the shoulder portion of the bottle-shaped can according to the number of drawing (or re-drawing) steps, and a clear boundary line is formed between the cylindrical portion and the slope portion. In order to eliminate those step-shaped portions and the boundary line thereby to provide a smooth slope, it is conceivable to perform the pressing working by using a pair of reforming tools having a curved slope of a domed longitudinal section or a slope of a straight longitudinal section, thereby to reform the shoulder portion which is formed profiling the surface shapes of those forming tools. Even with this pressing working, however, the step-shaped portions and the clear boundary line between the cylindrical portion and the slope portion are left as the forming marks of ring shape to degrade the appearance.

This will be described in more detail. According to the method for manufacturing the diametrically small cylindrical portion and the sloped shoulder portion gradually by repeating a plurality of drawing steps, as described above, the portion, as formed before re-drawn as the circumferential boundary line between the diametrically small cylindrical portion and the slope, is left in an apparent state as the circular mark in a portion of the sloped shoulder portion leading downward to the cylindrical portion which has been re-drawn into a smaller diameter.

If the drawing working is performed four times, three circular step portions (or three step-shaped portions) or boundary line marks are clearly left on the shoulder portion. These circular step portions or marks cannot be eliminated even after the shoulder portion was reformed.

Specifically, the portion, as has been the boundary line between the diametrically small cylindrical portion and the slope, is clearly left as the mark of the circular step portion or the boundary line on the shoulder portion which is newly formed at the subsequent drawing step, and this mark cannot be eliminated in the prior art even by reforming the shoulder portion.

The circular mark thus far described will not seriously affect the function of the container but will make an important point as the commercial goods. Specifically, the image of a commodity is expressed by the appearance of the container so that the beverage maker always demands for a design to stimulate the purchasing wills of the consumers. When the can is to be manufactured, therefore, it is an important point of design to form the shoulder portion from the neck portion to the can trunk into a smooth and beautiful curved slope of a domed longitudinal section or a smooth and beautiful slope of a straight longitudinal section. Hence, the aforementioned forming mark is earnestly desired to disappear because it is a fatal defect in the design.

Here in Japanese Patent Laid-Open No. 10-509095, especially in its FIGS. 18 to 27, there is disclosed a method for forming a cup trunk portion (or a side wall portion) into a diametrically small and thin cylindrical trunk portion. According to this method, the cup, as drawn from a blank punched out from a metallic sheet, is first drawn at its bottom portion repeatedly by several times (preferably, three or more) to form a diametrically small cylindrical neck portion. Next, the neck portion of the bottom portion is bulged at the domed shoulder portion. After this, the cup trunk portion (side wall portion) is re-drawn and ironed to form the diametrically small and thin cylindrical trunk portion.

According to the disclosed method, however, when the can trunk is formed, the metallic sheet material of the neck portion, as formed at the bottom of the cup, is pulled through the shoulder portion into the trunk portion of the can trunk as the metallic sheet material moves from the side wall portion of the cup to the thin trunk portion of the can trunk. As a result, the cylindrical shape of the neck portion, as formed at the bottom portion of the cup, cannot be kept in the initial shape so that the cylindrical vertical wall of the neck portion turns into a frusto-conical tapered wall. In this state, there arises a disadvantage that a predetermined thread cannot be formed at the step of threading the neck portion. In order to keep the sealing performance between the neck portion and the threaded cap, therefore, there arises a problem that the neck portion and the shoulder portion have to be reformed so as to raise the cylindrical neck portion as the vertical wall from the shoulder portion bulged in the domed shape.

A main object of the invention is to provide a bottle-shaped can manufacturing method capable of easily forming the aforementioned neck portion and the smooth shoulder portion leading to the neck portion.

More particularly, an object of the invention is to eliminate the boundary line, which has existed between the diametrically small cylindrical portion and the slope formed at steps from the first step of drawing the diametrically small cylindrical portion to the last but one drawing step, to such an extent as is hardly discriminated after the shoulder portion is reformed, although the elimination has been impossible in the prior art.

Specifically, an object of the invention is to provide a method for manufacturing a bottle-shaped can of a metallic sheet. The can bottom portion is drawn by a plurality of times to form a shoulder portion having a curved slope of an arcuate longitudinal section or a slope of a straight longitudinal section, and a diametrically small cylindrical neck portion. Even if the drawing working is repeated by a plurality of times to reduce the diameter of the neck portion to a predetermined diameter, a shoulder portion having a smooth and beautiful curved slope of domed shape or a slope of a straight longitudinal section is formed without apparently leaving the circular boundary line or its mark between the cylindrical portion and the slope portion, as formed by the drawing workings of several times, on the shoulder portion.

DISCLOSURE OF THE INVENTION

In order to achieve the above-specified objects, according to the invention, there is provided a bottle-shaped can manufacturing method for forming a shoulder portion having a slope and a diametrically small cylindrical neck portion integrally by further working the bottom side of a bottomed cylindrical can which is formed thinner at its trunk wall than at its bottom wall by drawing a metallic sheet having a thickness of 0.1 to 0.4 mm and by executing at least one thinning working of a bending/extending working and an ironing working, comprising: a step of preforming the bottom corner portion of the can into a curved shoulder face having an arcuate longitudinal section (i.e., a curved face to be formed into a portion of the shoulder portion); a first diametrically small cylindrical portion forming step of drawing the bottom of the can, with the curved shoulder face of the bottom corner portion being unwrinkled, into a diametrically smaller bottomed cylindrical shape than a trunk portion by using an unwrinkling pusher having the curved face shape of the shoulder portion on an outer face shape of its leading end portion, a drawing die having the curved face shape of the shoulder portion on an inner face shape of its leading end portion, and a drawing punch; a second diametrically small cylindrical portion forming step of drawing the bottomed cylindrical portion drawn from the can bottom, with the bottom corner portion being unwrinkled, into a diametrically smaller bottomed cylindrical shape, by using: an unwrinkling pusher having a tapered face having a substantially straight longitudinal section profiling a tangent line to an arcuate longitudinal section of a virtual curved face leading to the preformed curved shoulder face, a re-drawing die having a tapered face of a straight longitudinal section profiling a tangent line to an arcuate longitudinal section of a virtual curved face leading to the curved shoulder face at its portion to face at least the tapered face of the pusher, and a re-drawing punch; and a shoulder portion reforming step of pushing and extending the shoulder portion, which is formed by the first diametrically small cylindrical portion forming step and the second diametrically small cylindrical portion forming step, after the diameter of the bottomed cylindrical portion formed by executing the drawing working of the second diametrically small cylindrical portion forming step once or two or more times becomes substantially equal to that of the neck portion, into a smooth slope leading to the curved shoulder face on the trunk side.

According to the bottle-shaped can manufacturing method of the invention, the flat can bottom, as enclosed by the can bottom corner portion having the curved shoulder face formed in advance, of the bottomed cylindrical can is subjected to the first drawing by using the drawing die having the shape of the curved shoulder face on the inner face of its leading end and the unwrinkling pusher having the shape of the curved shoulder face on the outer face of its leading end portion, to preform the preformed curved shoulder face shape without wrinkling below the diametrically small bottomed cylindrical portion.

Even if the drawing step for forming the diametrically small neck portion is repeated a plurality of times, on the other hand, the second diametrically small cylindrical portion forming step or the second or later drawing step is performed by using the unwrinkling pusher having at its leading end portion the tapered face having a substantially straight longitudinal section profiling a tangent line to an arcuate longitudinal section of the virtual curved face leading to the curved shoulder face and the re-drawing die having at its leading end portion the tapered face of a substantially straight longitudinal section profiling a tangent line to an arcuate longitudinal section of a virtual curved face leading to the curved shoulder face. As a result, the shoulder portion is formed in the same surface shape or its repeated shape as the surfaces of the die and the pusher used at each drawing working. At the subsequent reforming steps, therefore, those tapered faces can be pushed and extended and can be reformed to form the shoulder portion having the smooth slope leading to the curved shoulder face of the trunk side.

On the other hand, the second diametrically small cylindrical portion forming step may include: the step of re-drawing the diametrically small cylindrical portion, with the bottom corner portion of the drawn diametrically small cylindrical portion being unwrinkled, by using an unwrinkling pusher having at its leading end portion a tapered face having a substantially straight longitudinal section profiling a tangent line to an arcuate longitudinal section of a virtual curved face leading to the curved shoulder face, a re-drawing die having at its leading end portion such a tapered face having the shape of a straight longitudinal section profiling a tangent line to an arcuate longitudinal section of the virtual curved face leading to the curved shoulder face as has a larger external diameter than that of the tapered face of the pusher, and a re-drawing punch; and the step of continuing the re-drawing working till the boundary line between the diametrically small cylindrical portion and the slope and the slope portion in the vicinity of the boundary line come into contact with the tapered face of the pusher and the tapered face of the die. Moreover, in the shoulder portion reforming step, one or two or more tapered faces of the straight longitudinal section may be pushed and extended into a smooth domed curved face leading to the curved shoulder face on the trunk side.

According to the bottle-shaped can manufacturing method of the invention, therefore, even if the drawing step of forming the diametrically small cylindrical portion is repeated a plurality of times on the flat can bottom which is enclosed by the bottom corner portion of the bottomed cylindrical can having the curved shoulder face formed in advance, at the second diametrically small cylindrical portion forming step or the second and later drawing step, the re-drawing is performed by using the pusher and the die which have at their individual leading end portions the tapered faces of the generally straight longitudinal section profiling a tangent line to an arcuate longitudinal section of the virtual curved face leading to the curved shoulder face and of which the die has a larger external diameter of the tapered face of the substantially straight longitudinal section than that of the pusher, i.e., a lower end portion of the tapered face of the die is positioned on the outside of a lower end portion of the tapered face of the pusher in the radial direction with respect to a can axis, and the drawing working is performed till the individual tapered faces of the die and the pusher come into contact with both the boundary line between the diametrically small bottomed cylindrical portion and the slope, as formed by the preceding drawing step, and the slope portion in the vicinity of the boundary line, so that neither the clear boundary line nor its mark is left on the shoulder portion.

Specifically, the boundary line (or the bent portion) between the slope and the diametrically small cylindrical portion, that is, the portion formed at the preceding step into the shape profiling the corner shape on the inner face of the leading end portion of the drawing die or the redrawing die comes, as the re-drawing proceeds, into abutment against the tapered face of the re-drawing die on the outer face of the can, so that the boundary line is made unclear (or the bent portion is shallowed) when it is pulled toward the diametrically small bottomed cylindrical portion while receiving the frictional resistance from the tapered face. When the boundary line passes through the clearance between the re-drawing die and the unwrinkling pusher being pushed toward each other, the unclear boundary line (or the shallowed bent portion) and the slope in the vicinity of the former are flattened by the pulling force, so that the portion to be formed to lead to the initial curved shoulder face does not become a step portion having the clear boundary line (or the deep bent portion) left.

Moreover, the shoulder portion is formed by the plurality of drawing steps into one or two or more tapered faces of a substantially straight longitudinal section, which are jointed by a low convex portion or ridge. At the shoulder portion reforming step, the tapered faces are pushed and extended into a continuous smooth domed curved face so that the shoulder portion jointing the diametrically larger cylindrical trunk portion and the diametrically smaller neck portion can be formed into a smooth and beautiful curved face of an arcuate longitudinal section leading to the curved shoulder face on the trunk side, with little forming mark (or the mark of the boundary line), as formed by the multiple drawing steps.

In the method of the invention, on the other hand, the tool to be used at the shoulder portion re-drawing step includes a pair of forming tools having a surface shape of a virtual curved face extending from the curved shoulder face, and the shoulder portion is reformed in its entirety into a smooth curved face of a domed longitudinal section leading to the curved shoulder face, by pinching most of the shoulder portion between the paired forming tools to push and extend the same.

By pushing and extending the shoulder portion by employing the paired forming tools having the surface shape of the virtual curved face extending from the curved shoulder face, therefore, the shoulder portion can be formed in its entirety into the smooth curved face of the arcuate longitudinal section leading to the curved shoulder face on the trunk side.

In the method of the invention, on the other hand, the second diametrically small cylindrical portion forming step may include: the step of re-drawing the diametrically small cylindrical portion, with the bottom corner portion of the previously drawn diametrically small cylindrical portion being unwrinkled, by using an unwrinkling pusher having at its leading end portion a slope having a substantially straight longitudinal section profiling a tangent line to an arcuate longitudinal section of a virtual curved face leading to the curved shoulder face, a re-drawing die having, at its portion to face the slope of the pusher, a slope having the shape of a straight longitudinal section profiling a tangent line to an arcuate longitudinal section of the virtual curved face leading to the curved shoulder face, at its portion on the leading end side from the slope, a convex curved face of an arcuate longitudinal section having a larger external diameter than that of the slope of the pusher, and a re-drawing punch; and the step of continuing the drawing working till the boundary line (or the bent portion) between the diametrically small cylindrical portion and the slope and the slope portion in the vicinity of the boundary line come into contact with the surfaces of the pusher and the die.

In the bottle-shaped can manufacturing method of the invention, at the second and later diametrically small cylindrical portion re-drawing step, therefore, both the boundary line (or the bent portion) between the diametrically small cylindrical portion and the slope, as formed at the preceding step into the shape profiling the corner shapes of the inner faces of the leading end portions of the drawing die and the re-drawing die, and the portion of the slope in the vicinity of the boundary line are brought, as the drawing proceeds, into abutment against the convex curved faces of the die so that the boundary line is made unclear (or the bent portion is shallowed) while it is pulled toward the diametrically small bottomed cylindrical portion while receiving the frictional resistance from the convex curved face. Moreover, the boundary line (or the bent portion) and its adjacent slope portion are flattened by the pulling force, when they pass through the clearance between the pusher and the die pushed toward each other, and the slope near the diametrically small cylindrical portion, as newly formed, is changed into a shallow concave curved face by receiving the convex curved face shape of the die transferred thereto.

This shallow concave curved face is easily formed into the smooth slope at the shoulder portion reforming step.

In the method of the invention, moreover, the slopes and convex curved faces of the unwrinkling pusher and the re-drawing die, as used when the second diametrically small cylindrical portion forming step is repeated two or more times, may be individually identical to those of the unwrinkling pusher and the re-drawing die, as used at the first step of the second diametrically small cylindrical portion forming step.

At the plurality of re-drawing steps, therefore, a plurality of shallow concave curved faces are formed in the slope portion for the shoulder portion so that the smooth slope is easily formed at the shoulder portion reforming step.

In the method of the invention, on the other hand, the tool to be used at the shoulder portion re-drawing step may include: a pair of forming tools having a surface shape of the tapered face of the straight longitudinal section profiling a tangent line to a virtual curved face leading from the curved shoulder face; and a punch to be inserted into the diametrically small cylindrical portion. Most of the shoulder portion can be formed into a smooth slope continuing in the straight longitudinal section shape leading to the curved shoulder face, by pinching the shoulder portion in its entirety between the paired forming tools and by applying a pushing force to the bottom portion of the diametrically small cylindrical portion thereby to push and extend the shoulder portion.

Therefore, most of the shoulder portion is pinched by the paired forming tools having the surface shapes of the tapered faces of a straight longitudinal section profiling a tangent line to a virtual curved face leading from the curved shoulder face, and the pushing force is applied to the bottom portion of the diametrically small cylindrical portion by the punch. As a result, the pulling force toward the diametrically small cylindrical portion is applied to the shoulder portion so that the shoulder portion having a plurality of shallow concave curved faces is pushed and extended, and so that the portion pinched by the paired forming tools takes the shape of the tapered face of the same straight longitudinal section as the surface shape of the forming tools.

As a result, at the shoulder portion reforming step, there is formed the shoulder portion which continuously leads to the curved shoulder face on the trunk side and which mostly has a smooth slope of continuous straight longitudinal sections.

In the method of the invention, on the other hand, a curved shoulder face is formed on the bottom corner portion of the can by preforming the bottom corner portion by using a punch having a curved face on the outer circumference of its leading end portion after the bottomed cylindrical can was formed by the drawing working and the thinning working and before the bottom side of the can is drawn.

Since the preparatory forming step is made independent, therefore, not only a curved face having a large radius of curvature but also a curved face having a small radius of curvature can be easily formed on the can bottom corner portion. By preforming the curved shoulder face on the bottom corner portion, on the other hand, it is possible to reform the curved shoulder face without wrinkling the lower end portion of the diametrically small cylindrical portion when forming the diametrically small cylindrical portion at the next drawing working step, and finally to make smooth and continuous either the cylindrical trunk portion and the curved face of a domed section or the cylindrical trunk portion and the shoulder portion having a slope of the straight longitudinal section.

In the method of the invention, on the other hand, the curved shoulder face is performed on the bottom corner portion of the can at the final forming step of the bottomed cylindrical can by using a punch having a curved face at the outer circumference of its leading end portion, as the punch to be used at the final working step of forming the bottomed cylindrical can which is made thinner at its trunk wall than at its bottom wall by the drawing working and by the thinning working.

At the final step of forming the cylindrical can having a thinner trunk wall than the bottom wall, therefore, the can bottom corner portion is curved to combine the trunk wall thinning step and the shoulder portion curved face preforming step into one step so that the number of working steps can be reduced.

In the method of the invention, on the other hand, the metallic sheet can be prepared by laminating a thermoplastic resin film on an aluminum alloy sheet in advance.

Since the aluminum alloy sheet is laminated on its two sides with the thermoplastic resin film, therefore, this thermoplastic resin film plays the role of a lubricant when the bottomed cylindrical can is to be formed by the drawing working or the thinning working, when the can is drawn on its bottom side or when the neck portion is threaded. When the aluminum alloy sheet is extended or bent, the laminating the thermoplastic resin film layer is accordingly extended or bent to reduce the consumption of the lubricant and to make the aluminum alloy sheet hard to be damaged with the working tools.

Since the laminating state with the thermoplastic resin can be kept even after the bottle-shaped can was formed, moreover, no new protecting coating is required later.

In the method of the invention, on the other hand, the metallic sheet is prepared by laminating a thermoplastic resin film on a surface-treated steel sheet in advance.

Since the surface-treated steel sheet is laminated on its two sides with the thermoplastic resin film, therefore, this thermoplastic resin film plays the role of a lubricant when the bottomed cylindrical can is to be formed by the drawing working or the thinning working, when the can is drawn on its bottom side or when the neck portion is threaded. When the surface-treated steel sheet is extended or bent, the laminating thermoplastic resin film layer is accordingly extended or bent to reduce the consumption of the lubricant and to make the surface-treated steel sheet hard to be damaged with the working tools.

Since the laminating state with the thermoplastic resin can be kept even after the bottle-shaped can was formed, moreover, no new protecting coating is required later.

In the method of the invention, moreover, the bottomed cylindrical can is so thinned that the thickness of the side wall in the vicinity of its bottom is less than the thickness of the metallic sheet before formed, but is 60% or more of the thickness of said metallic sheet.

As a result, the thickness of the side wall in the vicinity of the bottom of the bottomed cylindrical can or the portion to be drawn at the multiple stages is less than the thickness of the metallic sheet before the can is formed, but is 60% or more of the thickness of said metallic sheet. As a result, the corner portion is hard to be wrinkled, when it is preformed into the curved shoulder face, so that the joint portion from the trunk portion to the shoulder portion can be smoothly curved.

BEST MODE FOR CARRYING OUT THE INVENTION

A first embodiment of a method for manufacturing a bottle-shaped can of the invention will be described with reference to the accompanying drawings.

Figure 1:
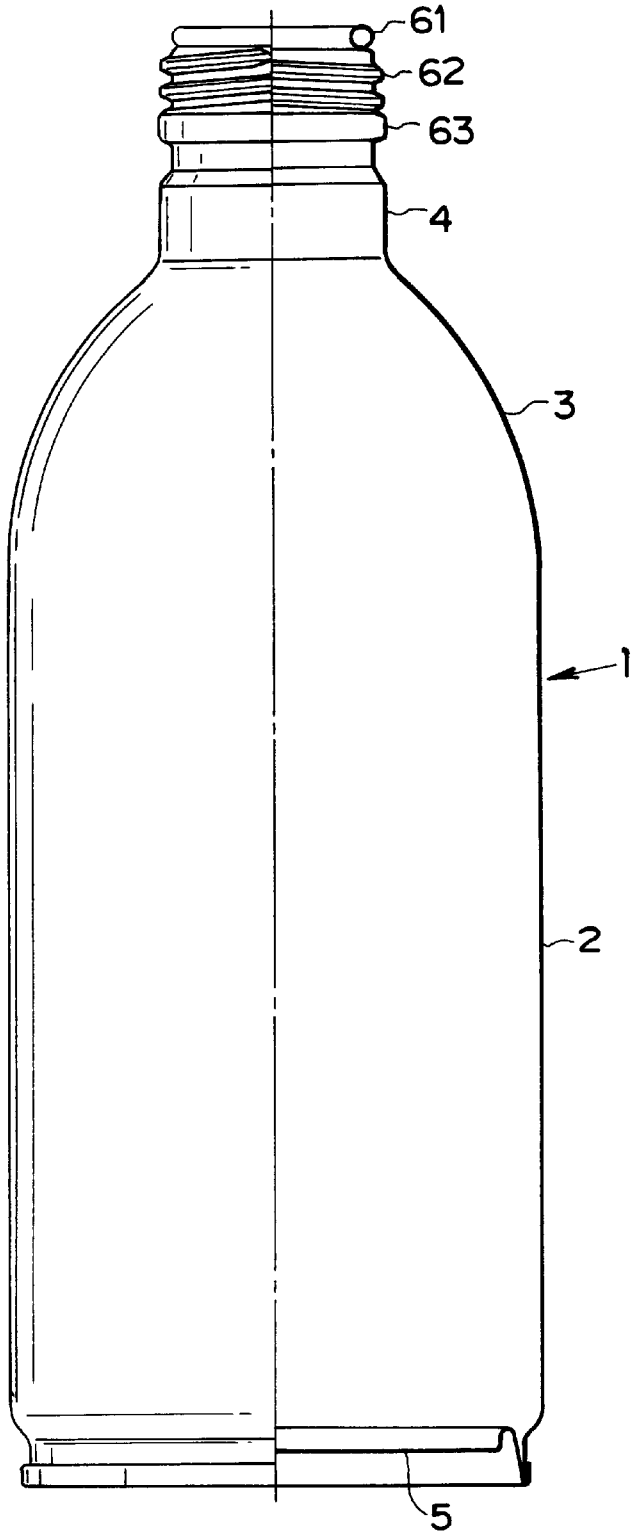
FIG. 1 is a partially sectional side elevation showing one example of a bottle-shaped can manufactured by a method of the invention with its right-hand half being section.

FIG. 1 shows one example of the bottle-shaped can to be manufactured by the method of the invention. The shown bottle-shaped can 1 is constructed to include: a can trunk 2 having a diametrically large cylindrical shape; a neck portion 4 having a diametrically small cylindrical shape and formed integrally with and upward from the can trunk 2 through a domed shoulder portion 3 having an arcuate longitudinal section; and a bottom end 5 seamed on the open lower end of the can trunk 2 to close the opening.

This bottle-shaped can 1 is characterized in its shape such that the shoulder portion 3 having a rounded curved slope smoothly joints the diametrically large cylindrical can trunk 2 and the diametrically small cylindrical neck portion 4. A curled portion 61 is formed at the upper end of the neck portion 4, and a threaded portion 62 is formed below the curled portion 61. Further below the threaded portion 62, there is formed an annular convex portion 63 for fixing a breakable band of a Pilfer proof cap or a tamper evidence cap.

Figure 2:
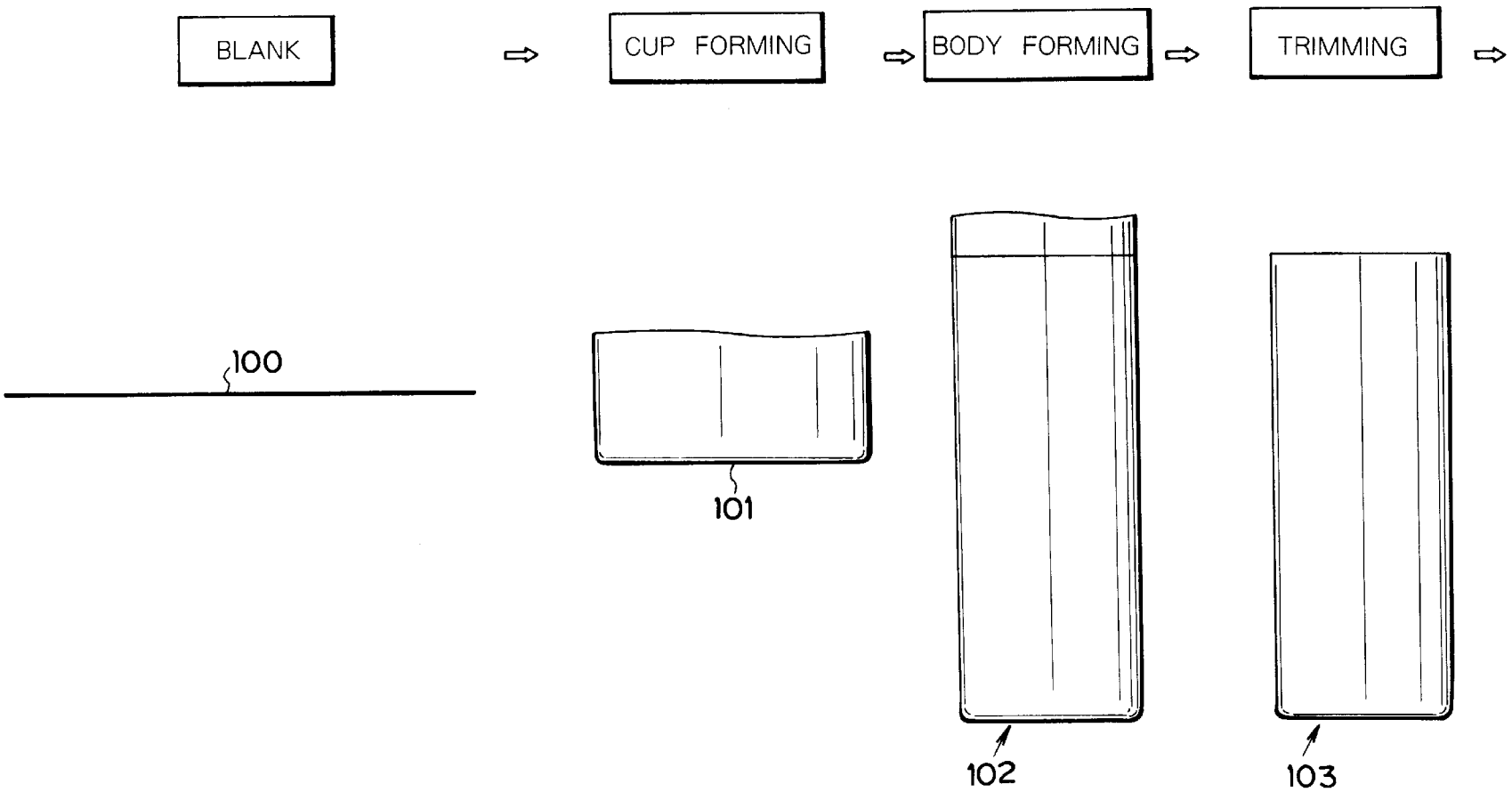
FIG. 2 is explanatory side elevations showing steps, in the method for manufacturing the bottle-shaped can shown in FIG. 1, of forming a bottomed cylindrical can from a circular blank punched from a metallic sheet, which shows the blank, a shape at a cup forming step, a shape at a body forming step and a shape at a trimming step, in order.

FIGS. 2 to 5 show the steps for manufacturing the bottle-shaped can 1 shown in FIG. 1. First of all, as shown in FIG. 2, a raw material of a metallic sheet is punched out into a disc shape as a blank 100 for one can. Next, this blank (i.e., the metallic sheet disc) 100 is drawn (as shown in FIG. 2) into a cup shape to form a cup 101. A side wall portion of this cup 101 is drawn (or re-drawn) and ironed into a cylindrical body 102 and is trimmed at its open end to a predetermined length (as shown in FIG. 2). By these series steps, there is manufactured a bottomed cylindrical DI (i.e., Drawn and Ironed) can 103 having one end opened.

For simplifying the description of FIG. 2, the drawing and ironing steps are integrated into one step but are preferably performed by dividing them into two to four steps so as to form the can trunk without difficulty.

At this step of forming the bottomed cylindrical can, on the other hand, the trimming step can be omitted, if there is adopted a forming method for leaving a flange on the open end side when the cup is drawn/ironed after drawn from the blank.

Figure 3:
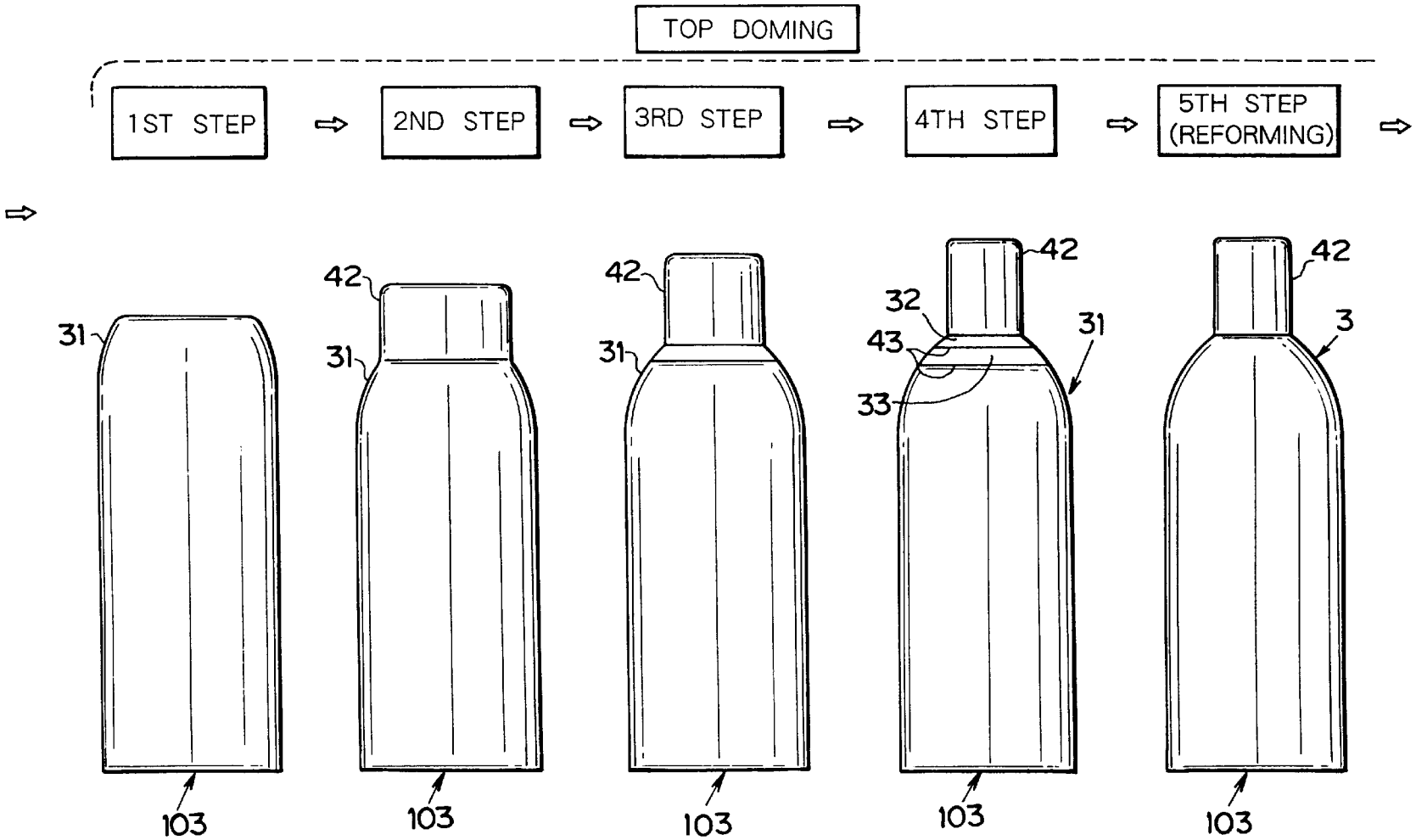
FIG. 3 is explanatory side elevations showing steps, in the method for manufacturing the bottle-shaped can shown in FIG. 1, of forming a top dome of a bottom of the bottomed cylindrical can, which shows a shape at a first step, a shape at a second step, a shape at a third step, a shape at a fourth step and a shape at a fifth step or a reforming step, in order.
Figure 4:
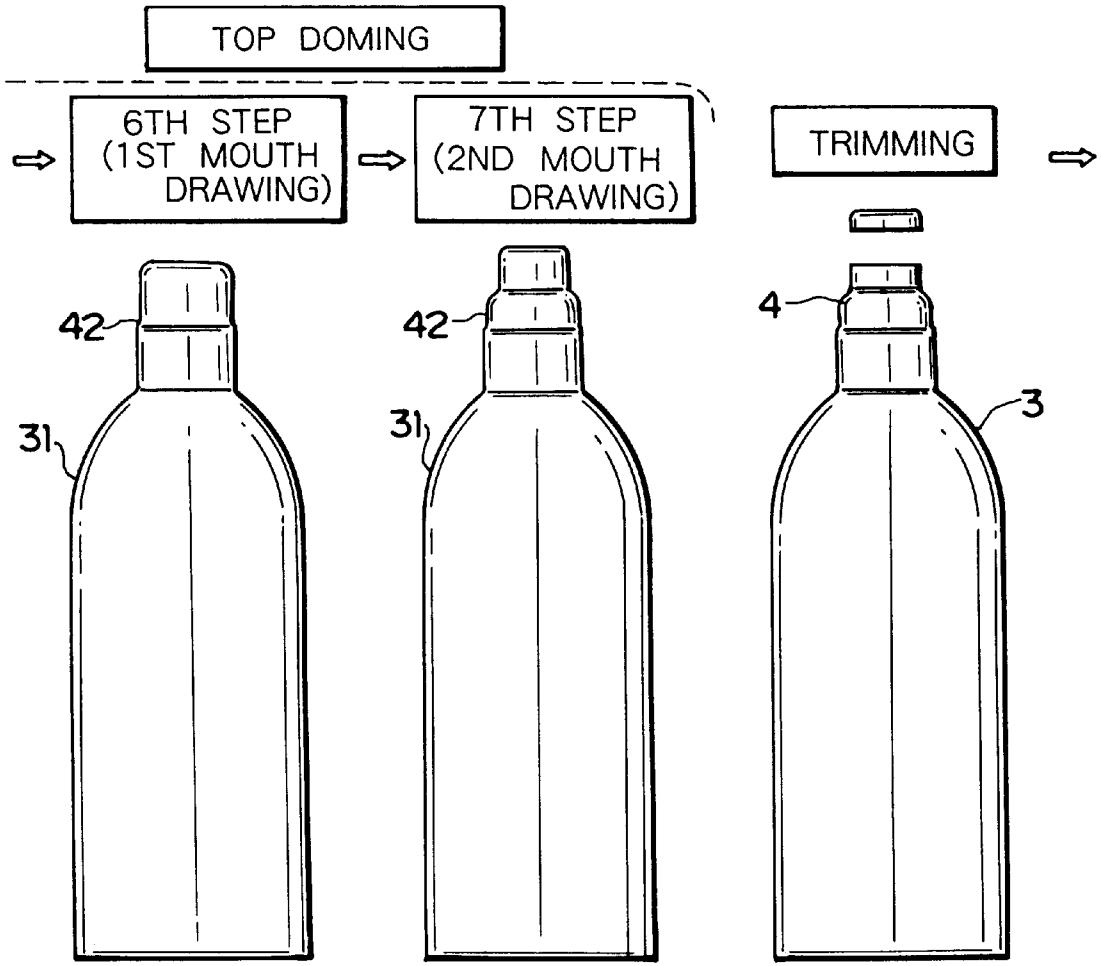
FIG. 4 is explanatory side elevations showing steps, in the method for manufacturing the bottle-shaped can shown in FIG. 1, of mouth-drawing and trimming a mouth of a diametrically small bottomed cylindrical portion of the bottomed cylindrical can formed by the top dome forming, which shows a shape at a first mouth-drawing step, a shape at a second mouth-drawing step and a shape at a trimming step, in order.
Figure 5:
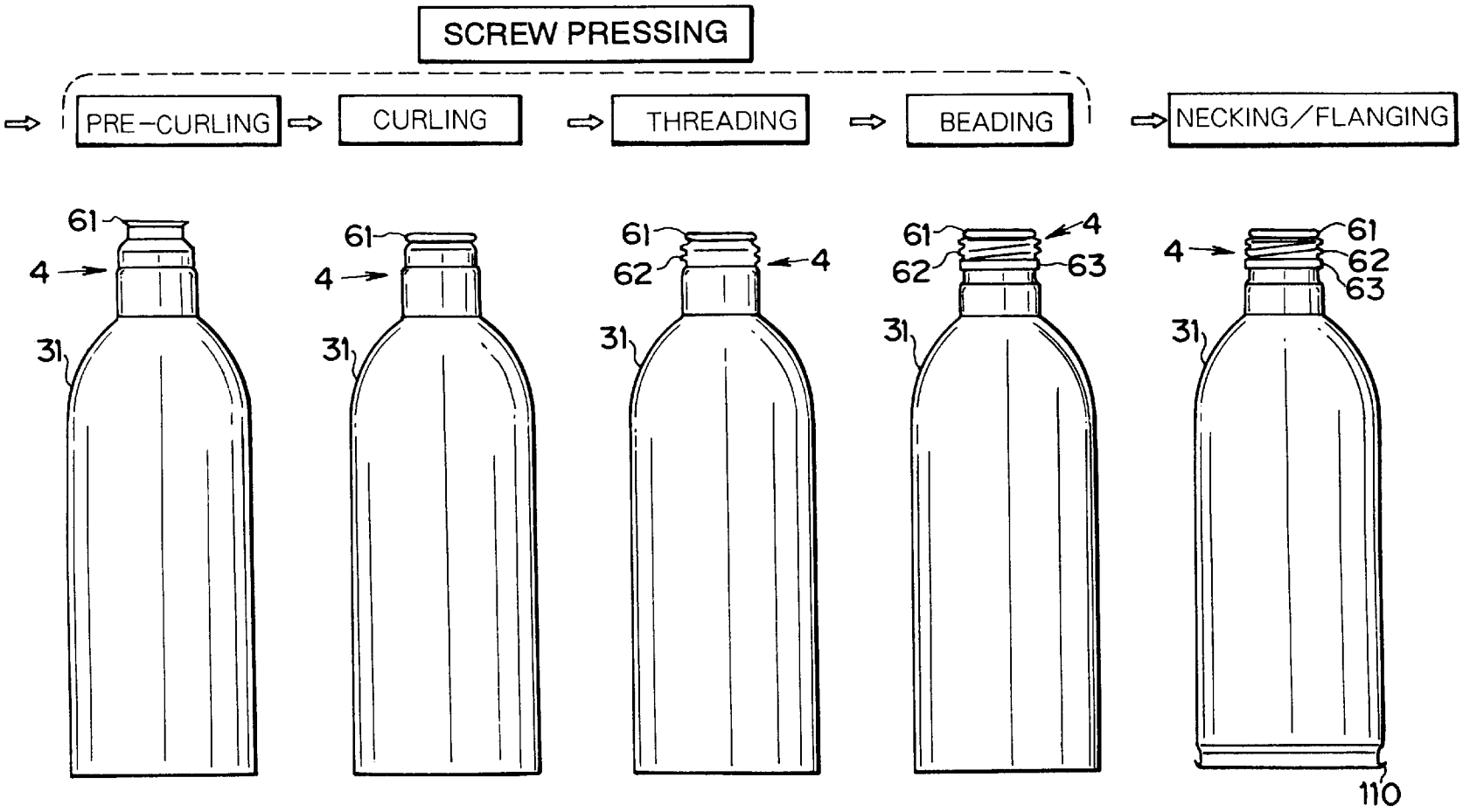
FIG. 5 is explanatory side elevations showing steps, in the method for manufacturing the bottle-shaped can shown in FIG. 1, of curling/threading a neck portion and necking-in and flanging an open lower end of a can trunk, which shows a shape at a pre-curling step, a shape at a curling step, a shape at a threading step, a shape at a beading step and a shape at a step of necking and flanging toward the open end side of the trunk, in order.

Then, the bottom side of the DI can thus manufactured is top-domed into a dome shape. At a first step of this top-doming, as shown in FIG. 3, a can bottom corner portion (including the can bottom and the can trunk near the bottom) of the DI can 103 is preformed into a curved shoulder face 31 having an arcuate longitudinal section. Here, FIGS. 3 to 5 show the can bottom on the upper side.

The curved shoulder face 31 is reformed below a diametrically small bottomed cylindrical portion 42 at the following drawing working (as referred to FIG. 3). This reformed curved shoulder face 31 finally turns into a joint portion to the cylindrical trunk portion and provides a portion for smoothing the joint between the trunk portion and the shoulder portion.

Figure 6:
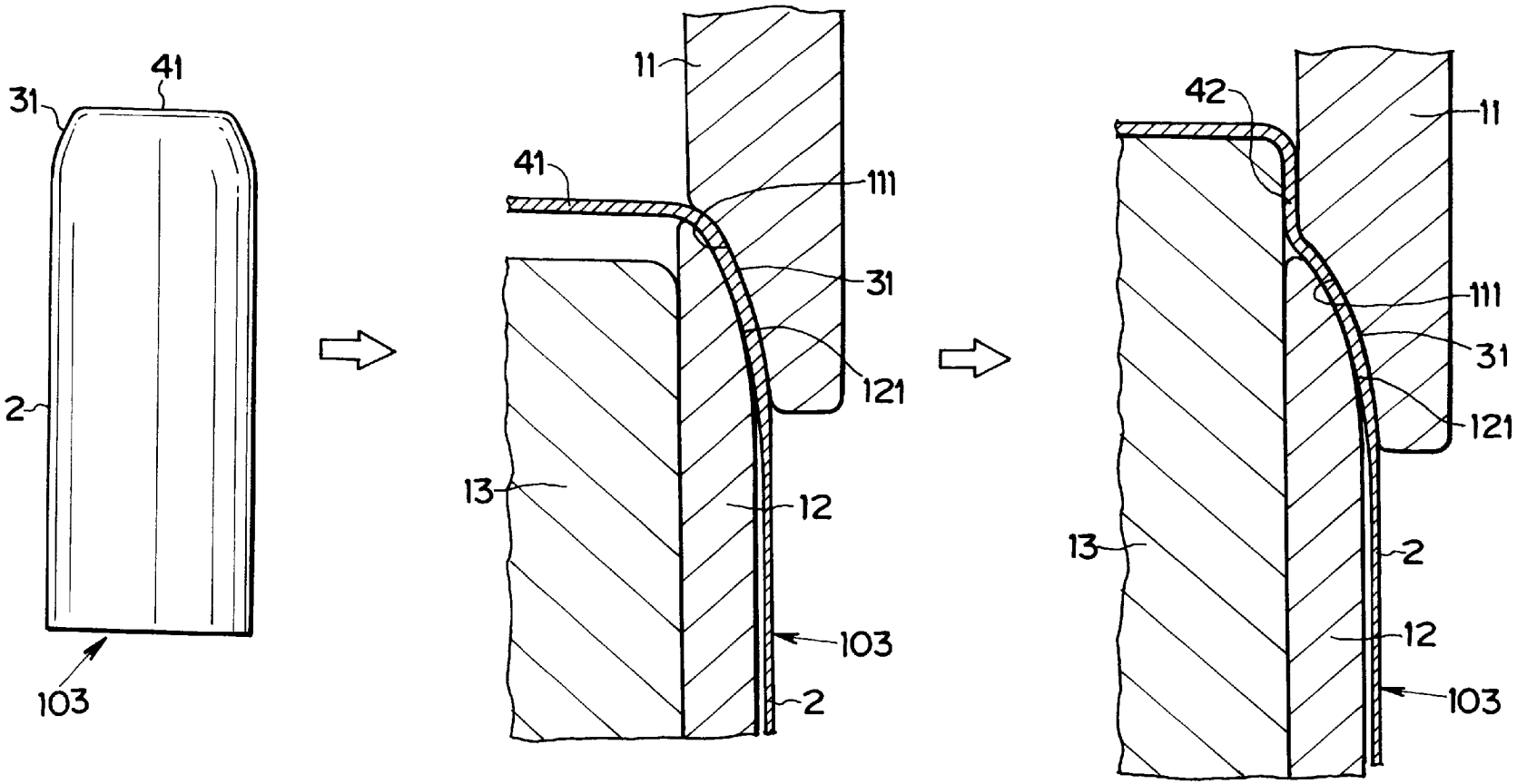
FIG. 6 is a view showing states, at the top doming step of the method for manufacturing the bottle-shaped can shown in FIG. 3, in which a bottom of a DI can having its bottom corner portion preformed into a curved shoulder face is drawn into a diametrically small bottomed cylindrical shape, which shows a front elevation of a preformed DI can, a sectional view showing a portion in a state at a drawing starting time and a sectional view a portion in a state of a drawing ended time, in order.

At a next second step, the flat can bottom is drawn into a diametrically smaller bottomed cylindrical shape than the can trunk (as shown in FIG. 3 and referred to FIG. 6). At this step, the preformed curved shoulder face 31 is reformed into a portion of the diametrically small bottomed cylindrical portion and the can trunk thereunder is reformed into the curved shoulder face 31 without being wrinkled. At a subsequent third step, a bottomed cylindrical portion 42 thus newly drawn is further drawn, with its bottom corner portion being unwrinkled, into a diametrically smaller bottomed cylindrical shape (as shown in FIG. 3 and referred to FIG. 7), by using: an unwrinkling pusher 15 having at its leading end portion a tapered face having a shape of a straight longitudinal section profiling a tangent line to an arcuate longitudinal section of a virtual curved face leading to the preformed curved shoulder face 31; a re-drawing die 14 having at its leading end portion such a tapered face having a shape of a straight longitudinal section profiling a tangent line to an arcuate longitudinal section of a virtual curved face leading to the curved shoulder face 31 as has a larger external diameter than that of the tapered face of the pusher 15; and a redrawing punch 16. At a fourth step, moreover, this drawing step is repeated once more to reduce a diameter of the bottomed cylindrical portion 42 until this portion 42 takes a diameter substantially equal to that of the neck portion. The tapered faces of the re-drawing die 14 and the unwrinkling pusher 15 at the fourth step are slopes having larger angles with respect to the can axis than those at the third step.

If the target diameter of the neck portion is substantially half or more a diameter of the trunk portion of the DI can although depending upon the thickness and hardness of the metallic sheet material employed, the diameter of the bottomed cylindrical portion 42 can be substantially equalized to the target diameter of the neck portion by the re-drawing of FIG. 3. In other words, the re-drawing steps of FIG. 3 can be omitted.

At these third and fourth steps, the boundary line (or bent portion) 43 between the slope of the shoulder portion and the bottomed cylindrical portion, as formed at the individually preceding steps, is pressed flat by forcing it through the clearance between the re-drawing die 14 and the pusher 15.

After this, at a fifth step, the upper portion of the shoulder portion 3 having two slopes 32 and 33, as formed subsequent to the initial curved shoulder face 31 by repeating such drawing, is pinched between a pair of forming tools 19 and 20 having curved shapes, to reform it into a continuous and smooth curved face.

Next, at sixth and seventh top-doming steps, as shown in FIG. 4, the bottomed cylindrical portion 42, as formed to have a diameter substantially equal to that of the neck portion 4, is mouth-drawn two times. Here, at the sixth step, the upper half of the bottomed cylindrical portion 42 is further drawn, and at the seventh step, the upper half of the upper half of the bottomed cylindrical portion, as has been drawn at the sixth step, is further drawn. After these steps, a closed upper end portion of the bottomed cylindrical portion 42 is trimmed. Thus, there is formed the neck portion 4 which has its upper end opened.

After this, as shown in FIG. 5, at the neck portion curling/threading steps, the neck portion 4 is externally curled at its open end portion to form an annular curled portion 61 (as shown in FIG. 5), and the neck portion 4 is threaded at its cylindrical circumference wall leading downward from the curled portion 61, to form the threaded portion 62 to be fastened by the threaded portion of the not-shown Pilfer proof cap, and to form below the threaded portion 62 the annular convex portion 63 for fixing the breakable band of the Pilfer proof cap.

Then, the can trunk is necked-in and flanged at its open lower end edge 110, as opposed to the neck portion. At a not-shown next step, moreover, the bottom end 5 or a separate member of a metallic sheet is integrally fixed on the open lower end edge 110 by a double seaming method, to complete the bottle-shaped can 1.

Here will be described in more detail one specific embodiment of the manufacture of the bottle-shaped can which has the curved face at its shoulder portion.

The raw material or the metallic sheet is prepared to have a thickness of 0.1 to 0.4 mm by laminating a thermoplastic resin film of polyester resin, polypropylene resin or other resin on two sides of an aluminum alloy sheet. Specifically, the metallic sheet employed is prepared by laminating a polyethylene terephthalate having a thickness of 20 micron meters on the two sides of an aluminum alloy sheet (according to 3004H191 of the Japanese Industrial Standards (JIS)) having a thickness of 0.315 mm).

To the surface of this laminated metallic sheet, there is applied the well-known lubricant such as normal butyl stearate, fluid paraffin, petrolatum, polyethylene wax, palm oil and the like.

Here, the method for laminating the thermoplastic resin film on the raw material or the metallic sheet is exemplified not only by the method for thermally adhering the thermoplastic resin film directly to the metal surface of the metallic sheet but also by thermally adhering the thermoplastic resin film on the metal surface of the metallic sheet through an adhesive primer layer, a hardening type adhesive layer or an excellently thermally adhesive thermoplastic resin layer.

The blank 100 for each can is punched from the above-specified metallic sheet into a disc shape having a diameter of 170 mm. This disc-shaped blank 100 is drawn into a cup shape having a height of 48.3 mm and an external diameter of 100 mm. This cup 101 is drawn/ironed at its side wall and is then trimmed at the end portion of its open end side to form the bottomed cylindrical DI can 103 having a height of 171.5 mm and an external diameter of 65.9 mm.

The trimming step at this stage can be omitted, as has been described hereinbefore, by drawing the cup 101 of the external diameter of 100 mm, when re-drawn, to leave a flange at its open end, and by leaving the flange at the subsequent drawing steps.

Prior to drawing the bottom side of the bottomed cylindrical DI can 103 into the top of the bottle-shaped can having the shoulder portion 3 of the arcuate longitudinal section and the diametrically small cylindrical neck portion 4, that is, prior to forming the can bottom into the domed shoulder portion and the diametrically small cylindrical neck portion, the contact between the polyethylene terephthalate film covering the DI can 103 and the aluminum alloy sheet is improved by heating the entirety to a temperature higher than the melting point of the polyethylene terephthalate resin and then by quenching the polyethylene terephthalate film into an amorphous state. Here, the polyethylene terephthalate film may be made amorphous just after the step of laminating the film on the aluminum alloy sheet.

Next, the drawing step of forming the bottom side of the DI can 103 into the shoulder portion 3 and the neck portion 4, that is, the working steps shown in FIG. 3, is exemplified in the embodiment by the following neck portion drawing method.

First of all, the DI can 103 drawn/ironed into the bottomed cylindrical shape is preformed at its bottom corner portion into the curved shoulder face 31 having the arcuate longitudinal section, as shown in FIG. 6, by mounting the DI can 103 on the (not-shown) punch having a curved outer circumference edge at its leading end, and by moving the punch to a position where the punch and the (not-shown) die of which its inner circumference face has a shape profiling an outer circumference edge of the punch abut to pinch the bottom 41 of the DI can 103.

Next, as shown in FIG. 6, the curved shoulder face 31 of the can bottom corner portion is unwrinkled by tools having curved faces 111 and 121 to contact closely with the curved shoulder face 31, that is, a drawing die 11 to contact with the outer face of the curved shoulder face 31 and an unwrinkling pusher 12 to contact with the inner face of the curved shoulder face 31. In this state, the flat bottom 41 of the DI can 103 is drawn into the bottomed cylindrical portion 42 of a smaller diameter than that of the can trunk by means of a drawing punch 13. At this drawing step, the portion as the curved shoulder face 31 is reformed into the bottomed cylindrical portion 42 and the portion as the cylindrical trunk is reformed into the curved shoulder face.

Below the bottomed cylindrical portion 42, the curved shoulder face 31 is reformed without wrinkling and changing its shape substantially.

Figure 7:
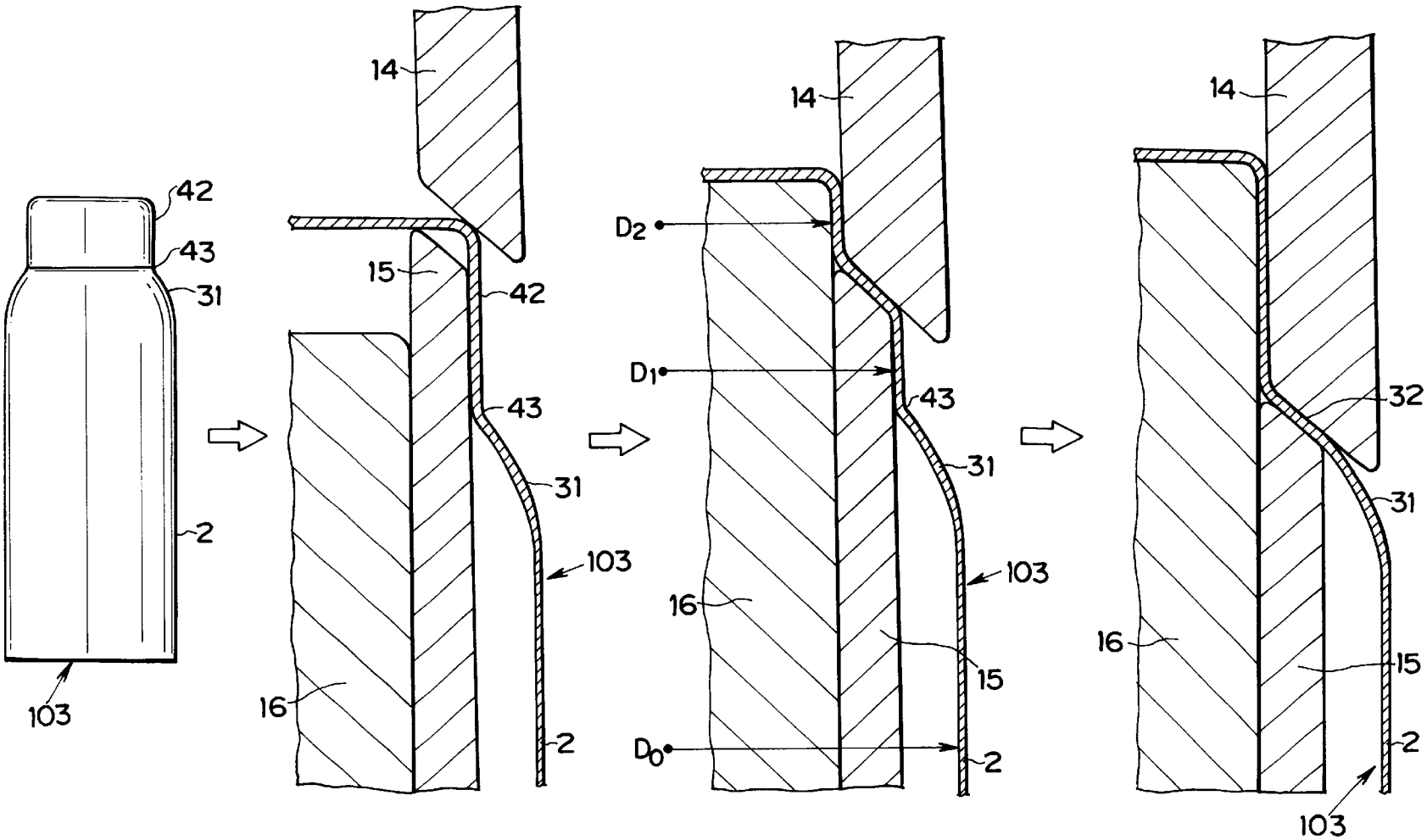
FIG. 7 is a view showing states, at the top doming step of the method for manufacturing the bottle-shaped can shown in FIG. 3, in which the DI can having its bottom drawn into the diametrically small bottomed cylindrical shape is drawn at its diametrically small bottomed cylindrical portion to have a smaller diameter, which shows a front elevation of the DI can of which the bottom is drawn into the diametrically small bottomed cylindrical shape, a sectional view showing a portion in a state at a forming starting time, in which the DI can is further diametrically reduced, a sectional view showing a portion in a state in a diametrically reducing course and a sectional view showing a portion in a state of a diametrically reducing ended time, in order.

After this, as shown in FIG. 7, the bottomed cylindrical portion 42 newly drawn is re-drawn by using: the unwrinkling pusher 15 having at its leading end portion a tapered face having a shape of a substantially straight longitudinal section profiling a tangent line to an arcuate longitudinal section of a virtual curved face leading to the curved shoulder face 31; the re-drawing die 14 having at its leading end portion such a tapered face having a shape of a substantially straight longitudinal section profiling a tangent line to an arcuate longitudinal section of a virtual curved face leading to the curved shoulder face 31 as has a larger external diameter than that of the tapered face of the pusher 15; and the re-drawing punch 16. With the bottom corner portion of the bottomed cylindrical portion 42 being unwrinkled by the pusher 15 and the die 14, more specifically, the bottomed cylindrical portion 42 is re-drawn into a bottomed cylindrical shape of a smaller diameter by the punch 16. This step corresponds to the second diametrically small cylindrical portion forming step of the invention.

Here in this Specification, the tapered face having a substantially straight longitudinal section means that the longitudinal section need not be straight but has a substantially flat face for performing the unwrinkling action on the bottomed cylindrical portion between the pusher 15 and the die 14 facing each other. Furthermore, in this specification, a tangent line to an arcuate longitudinal section of a virtual curved face leading to a curved shoulder face means a tangent line to a position to be occupied in a domed shoulder portion 3, i.e., a curved shoulder face and a virtual curved face leading thereto by a slope to be a portion of the shoulder portion formed at a re-drawing step, for forming the domed shoulder portion 3 of FIG. 1 by extending the curved shoulder face 31.

After this, the re-drawing of the formed diametrically small cylindrical portion into a diametrically smaller bottomed cylindrical portion is repeated until the diameter of the bottomed cylindrical portion becomes substantially equal to a predetermined diameter of the neck portion 4. This working step corresponds to the repetition of the second diametrically small cylindrical portion forming step (or to the twice or more executions of the second diametrically small cylindrical portion forming step).

Here, if the ratio of the diameter of the neck portion 4 to be formed to the diameter of the trunk portion 2 of the DI can 103 is one half or more, the repetition of the second diametrically small cylindrical portion forming step can be omitted, as described hereinbefore.

Here, the individual tapered faces of the re-drawing die 14 and the unwrinkling pusher 15 to be used at the second diametrically small cylindrical portion formation repeating step are the tapered faces having a substantially straight longitudinal section profiling a tangent line to an arcuate longitudinal section of a virtual curved face leading to the curved shoulder face 31, so that the pusher 15 and the die 14 to be used at the drawing steps of the later orders have the tapered faces of the gentler slopes. In other words, the tapered faces are set to have a larger angle with respect to the axis of the can (or a larger slope angle with respect to the axis of the bottomed cylindrical portion 42) than that of the individual tapered faces of the re-drawing die 14 and the unwrinkling pusher 15 used at the second diametrically small cylindrical portion forming step.

What is important at this step is that the external diameter of the die 14 to contact with the outer face of the can bottom is larger than that of the pusher 15 to contact with the inner face of the can bottom, namely, as shown in FIG. 7, that a lower end of the tapered face of the die 14, which extends downward in an oblique direction, extends from the can axis to the outer side of a lower end of the tapered face of the pusher 15, which extends downward in an oblique direction (especially, the lower end of the tapered face of the die 14 is positioned in an outer side of the side wall of the formed diametrically small cylindrical portion at the preceding step in a radial direction with respect to the can axis).

As the re-drawing of the bottom corner portion proceeds so far that the punch 16 abutting against the can bottom moves forward, the diametrically small bottomed cylindrical portion is elongated from the state shown in FIG. 7. In this case, the boundary line (or bent portion) 43 between the upper end of the curved shoulder face 31 and the lower end of the bottomed cylindrical portion 42 and the slope portion in the vicinity of the boundary line 43 are gradually brought close to and finally brought into contact with the tapered face of the die 14 by the pulling force from the side of the diametrically small bottomed cylindrical portion so that they are further pulled while being intensely pushed by the tapered face. During this working, the boundary line 43 is made unclear by that pulling force and by the pulling action of the frictional resistance on the tapered face of the die 14. In other words, the bending degree of the bent portion 43 is drastically reduced.

Moreover, the pulling force successively acts so that the boundary line (or the bent portion) 43 and its adjacent slope portion are pulled into the clearance between the tapered face of the die 14 and the tapered face of the pusher 15, as opposed to each other while generating the pushing force. As a result, the pulling action acts on the portion of the boundary line 43 (or the portion of the bent portion 43) so that the portion of the boundary line 43 (or the portion of the bent portion 43) is stretched into a substantially flat or smooth curve, as shown in FIG. 7.

Here, if the external diameter of the tapered face of the re-drawing die 14 is equal to or smaller than that of the tapered face of the unwrinkling pusher 15, the boundary line (or the bent portion) 43 and its adjacent slope portion are neither brought into abutment against the tapered face of the die 14 nor made unclear, or the bending degree of the bent portion 43 is not reduced by the pulling force coming from the bottomed cylindrical portion as the re-drawing proceeds, but they are instantly pulled into the clearance between the tapered face of the die 14 and the tapered face of the pusher 15. Accordingly, the shoulder portion, as so formed at the preceding drawing step as to lead to those portions, is pulled in its entirety all at once into the clearance between the pusher 15 and the die 14.

Let it be assumed that the bottomed cylindrical can has a radius D0, the diametrically small bottomed cylindrical portion formed by the first drawing has a radius D1, and the diametrically small bottomed cylindrical portion formed by the second drawing has a radius D2, as shown in FIG. 7. Even if the second drawing ratio D1/D2 is set at a considerably surplus value, e.g., about 1.3 to the limit drawing ratio (e.g., about 1.5), the substantial drawing ratio approaches the ratio D0/D2 when the drawing changes to pull the entire shoulder portion all at once into the clearance between the die 14 and the pusher 15. In this case, therefore, the drawing exceeds the limit drawing ratio so that the shoulder portion is wrinkled.

Figure 8:
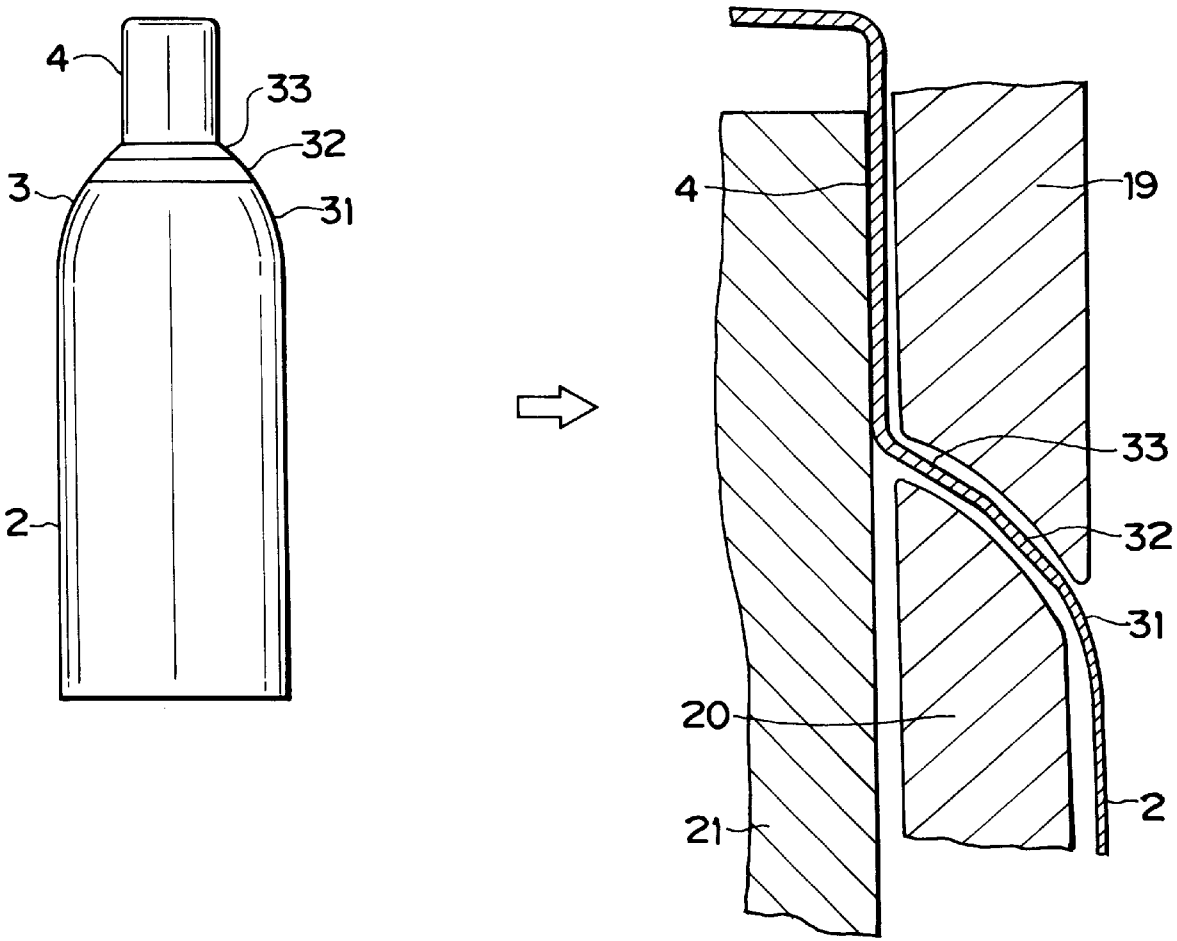
FIG. 8 is a view showing states, at the top doming step of the method for manufacturing the bottle-shaped can shown in FIG. 3, in which a shoulder portion of the DI can formed with the shoulder portion and a neck portion is reformed into a smooth domed shape in its entirety, which shows a front elevation showing the DI can formed with the shoulder portion and the neck portion and a sectional view showing a portion in a reformed state, in order.

As described hereinbefore, the diametrically small bottomed cylindrical portion 42 is drawn, with its bottom corner portion being unwrinkled by the individual tapered faces of the die 14 and the pusher 15, into a diametrically smaller bottomed cylindrical shape by the punch 16, by using: the unwrinkling pusher 15 having at its leading end portion the tapered face having the shape of a straight longitudinal section profiling a tangent line to an arcuate longitudinal section of a virtual curved face leading to the curved shoulder face 31; the re-drawing die 14 having at its leading end portion such a tapered face having the shape of a straight longitudinal section profiling a tangent line to an arcuate longitudinal section of a virtual curved face leading to the curved shoulder face 31 as has a larger external diameter than that of the tapered face of the pusher 15; and the re-drawing punch 16. As a result, the boundary line 43, as formed at the preceding drawing step, and its adjacent slope portion are caused by the pulling force from the bottomed cylindrical portion and the frictional resistance on the tapered face of the die 14 to reduce their bending degree drastically. Subsequently, the boundary line 43 and its adjacent slope portion are pulled into the clearance between the die 14 and the pusher 15, so that the boundary line 43 and its adjacent slope portion are flattened by the stretching action coming from the pulling force and the pressures of the die 14 and the pusher 15. Since this drawing of the can bottom 41 is separately performed several times (e.g., three times in this embodiment), moreover, the shoulder portion 3 is formed into the preformed curved shoulder face 31 and a plurality of (e.g., two) profiling tapered faces 32 and 33, as shown in FIG. 8.

The boundary line portions between the curved shoulder face 31 and the tapered faces 32 and 33 thus preformed have no abruptly changing portion so that the shoulder portion 3 can be reformed in its entirety into a smooth dome shape leading to the preformed curved shoulder face 31 by pushing and stretching them by means of the paired forming tools (e.g., the die 19 to contact with the outer face of the shoulder portion and the pusher 20 to contact with the inner face of the shoulder portion) having the shape of the virtual curved faces extending from the curved shoulder face 31.

Here will be further described the number of repetitions of the aforementioned drawing of the bottomed cylindrical portion.

Depending upon the thickness and material of the DI can, there is determined the drawing degree (or the drawing ratio) for one time, according to which there is determined the number of drawings for forming the can trunk of a predetermined diameter into a bottomed cylindrical portion of a predetermined diameter.

In the re-drawing case of a thin metallic sheet (e.g., an aluminum alloy sheet or a surface-treated steel sheet) having a thickness of 0.1 to 0.4 mm as for beverage DI cans, the drawing ratio is usually set within the value 1.5 (i.e., the limit drawing ratio). If this drawing ratio is exceeded, wrinkles are formed. Even if the wrinkling is prevented by raising the unwrinkling pressure at the drawing time, on the other hand, the probability of breaking the material rises. Since the work hardening is raised as the re-drawing is repeated, moreover, the limit drawing ratio becomes smaller and smaller.

Generally, DI cans having a trunk external diameter of 66 mm (or the 211 diameter) are employed for drinks such as beer or carbonated beverages, for example. When the bottle-shaped cans are to be formed by using the DI cans, therefore, three drawing steps are necessary for the neck portion (i.e., the maximum diameter portion of the neck portion) having the final external diameter of 28 mm and a drawing ratio of 1.3.

A further description will be made on the drawing method employing the drawing die and the unwrinkling pusher thus far described.

The intrinsic roles of the drawing die and the unwrinkling pusher to be employed for the drawing working are to prevent the original metallic sheet material from being wrinkled by the circumferential shrinkage which will occur in the metallic sheet material when this material is forced to the inner face of the drawing die by the punching pressure. Therefore, these die and pusher function to push the metallic sheet material under a predetermined pressure to keep the metallic sheet material to flow on the inner face of the die at a predetermined thickness.

At the re-drawing time, according to the invention, the boundary line 43 between the bottomed cylindrical portion, as formed by the drawing of the preceding step, and the sloped shoulder portion is pushed by the die 14 and the pusher 15 having at their leading end portions the tapered faces having the shape of a straight longitudinal section profiling a tangent line to an arcuate longitudinal section of a virtual curved face leading to the preformed curved shoulder face 31, thereby to reduce the bending degree of the boundary line 43 drastically or to flatten it.

Here, if the re-drawing die 14 and the unwrinkling pusher 15 having shapes identical to the curved shape of the shoulder portion leading to the preformed curved shoulder face 31 are employed for re-drawing the bottomed cylindrical portion (specifically, at the steps shown in FIG. 7), the metallic sheet material of the preformed curved shoulder face 31 is pulled by the diametrically small bottomed cylindrical portion, when drawn by the re-drawing punch 16, as it migrates from the original bottomed cylindrical portion (i.e., the bottomed cylindrical portion formed at the preceding step) to the bottomed cylindrical portion newly drawn. As a result, the bottomed cylindrical portion is drawn at a higher drawing ratio than the predetermined one to wrinkle the curved shoulder face 31.

As the drawing working proceeds, more specifically, most of the curved shoulder face 31, as moved by the pulling force from the bottomed cylindrical portion, is brought into contact with the die 14 having the shape identical to that of the curved shoulder face, before it goes into the clearance between the tapered face of the re-drawing die 14 and the tapered face of the unwrinkling pusher 15. Accordingly, the diametrically large trunk portion of the cylindrical can is drawn, as if all at once, into the diametrically small bottomed cylindrical portion. As a result, even if the drawing ratio D1/D2 of the second re-drawing step is set to about 1.3 with a considerable surplus with respect to the limit drawing ratio, the substantial drawing ratio approaches the value D0/D2 so that it exceeds the limit value to wrinkle the shoulder portion.

According to the method for manufacturing the bottle-shaped can of this embodiment, on the contrary, the drawing working is performed by the aforementioned method using the paired tools having the tapered faces having the shape of a straight longitudinal section profiling a tangent line to an arcuate longitudinal section of a virtual curved face leading to the preformed curved shoulder face 31 (i.e., the unwrinkling pusher 15 and the re-drawing die 14 having the tapered face of a larger external diameter than that of the tapered face of the pusher 15). As a result, no step portion is formed on the shoulder portion even when the drawing working for forming the neck portion is repeated.

On the other hand, the shoulder portion to be formed subsequent to the preformed curved shoulder face can be formed as a combination of a plurality of tapered faces profiling the curved face so that no step portion is formed between the tapered faces.

As a result, the plurality of tapered faces are reformed while being pushed and stretched into a smoothly curved face by the paired forming tools having shapes of virtual curved face extending from the curved shoulder face 31 (i.e., the die 19 to contact with the outer face of the shoulder portion and the pusher 20 to contact with the inner face of the shoulder portion), as shown in FIG. 8, so that the shoulder portion can be formed to have a curved face having a smooth and beautiful dome without leaving any forming mark.

After the diametrically small bottomed cylindrical portion having a diameter substantially equal to that of the neck portion and the shoulder portion having a domed and curved face were formed, the upper half of the bottomed cylindrical portion 42 is drawn to a smaller diameter, as shown in FIG. 4, and its upper half is further drawn to a smaller diameter. After this, the leading end portion of the diametrically small bottomed cylindrical portion is trimmed and opened. After this, as shown in FIG. 5, the open end of the neck portion 4 is pre-curled slightly outward, and this pre-curled portion is externally curled to complete the curled portion 61. Then, the helically threaded portion 62 is formed below that curled portion 61. The annular concave portion is formed below the threaded portion 62 to form the annular convex portion 63 below the threaded portion 62 so as to fix the breakable band of the Pilfer proof cap. After this, the open end of the trunk portion, as located on the opposite side of the neck portion 4, is necked in and flanged, as known in the art, to make preparations for seaming the bottom end.

The bottom end for closing the lower end opening, as located on the opposite side of the neck portion 4, of the can trunk, is made of an aluminum alloy sheet (according to 5182-H39 of the Japanese Industrial Standards (JIS)) having a thickness of 0.285 mm and a diameter of 62.6 mm and having a polyethylene terephthalate film of a thickness of 20 micron meters thermally adhered on its two sides. This can end is integrally fixed by doubly seaming it on the open lower end edge of the necked-in and flanged can trunk.

In the present embodiment thus far described, the bottle-shaped can is manufactured of such a metallic sheet having the synthetic resin covering as is prepared by laminating the thermoplastic resin film of the polyester resin, the polypropylene resin or the like in advance on the two side of the aluminum alloy sheet, so that a sufficient corrosion-resistance can be applied even to the diametrically small threaded neck portion which has a structure hard to be coated after the bottle-shaped can is formed.

At the working time for the metallic sheet drawing, bending/extending (or stretching), ironing, beading or threading working, the thermoplastic resin film layer laminating the metallic sheet surface plays the role of a lubricant and extends and bends accompanying the metallic sheet being extended and bent, the covering state of the film can be kept satisfactory even after the can is formed, although the can has not only the thinned trunk but also the curled and threaded diametrically small neck portion.

Here in the method for manufacturing the bottle-shaped can of this embodiment, the vicinity of the can bottom of the thinned can trunk (or the side wall portion) of the bottomed cylindrical can is reformed into the shoulder portion (or a part of the shoulder portion). In order to prevent the vicinity of the can bottom from being wrinkled at the reforming time, it is preferable that the thickness of the can trunk portion (i.e., the side wall portion in the vicinity of the can bottom) to be reformed is as thick as 60% or more of the thickness (equal to the thickness of the metallic sheet before worked) of the can bottom.

Next, a second embodiment of the method for manufacturing the bottle-shaped can of the invention will be described with reference to FIGS. 9, 10 and 11.

Figure 9:
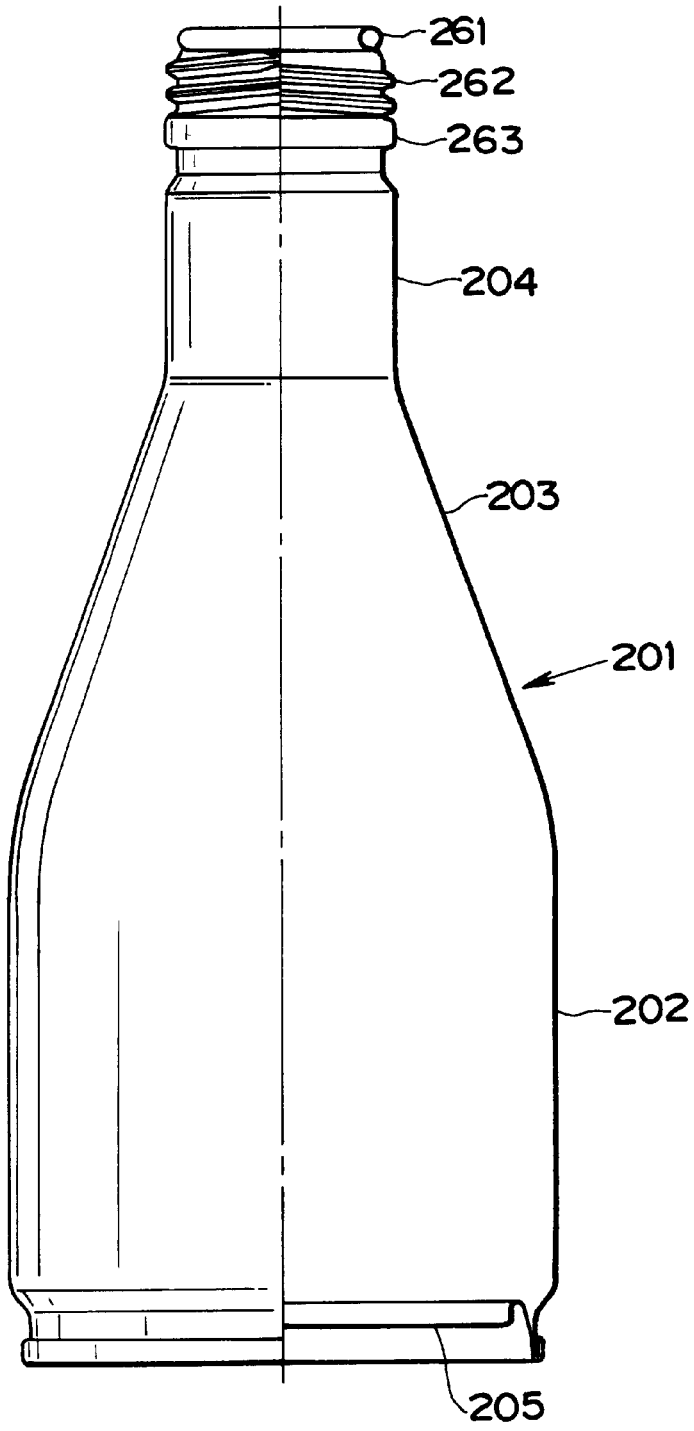
FIG. 9 is a partially sectional side elevation showing another example of a bottle-shaped can manufactured by a method of the invention with its right-hand half being in section.

FIG. 9 is a front elevation showing an example of a bottle-shaped can having a different shape of a shoulder portion from that of the bottle-shaped can having been described in connection with the first embodiment, with its right-hand half being in section.

Figure 10:
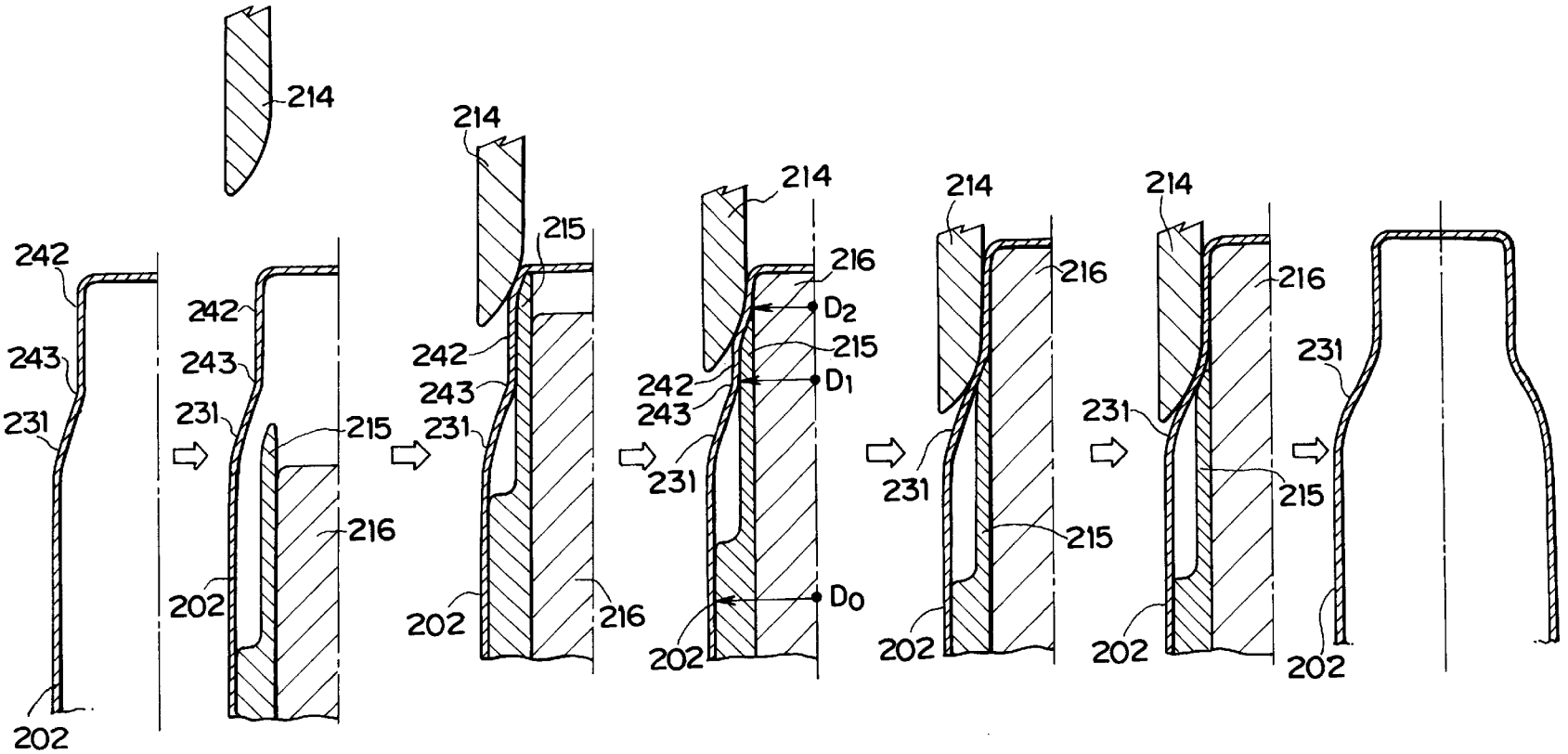
FIG. 10 is a view showing steps, in a second embodiment of the method for manufacturing the bottle-shaped can of the invention, at which a thin can having its bottom drawn to form a diametrically small cylindrical portion is re-drawn to further reduce a diameter, which shows a front elevation showing a shape of the diametrically small cylindrical portion before drawn, a sectional view of a portion showing a state at a drawing starting time, a sectional view of a portion of a state in which a drawing of the diametrically small cylindrical portion is started, a sectional view showing a portion of a state in which the drawing proceeds to an intermediate portion of the diametrically small cylindrical portion, a sectional view showing a portion of a state in which the drawing proceeds to a root portion of the diametrically small cylindrical portion, a sectional view showing a portion of a state in which a drawn diametrically small cylindrical portion is stretched toward the shoulder portion and a sectional view showing a shape of a diametrically small cylindrical portion finished with a re-drawing, in order.

On the other hand, FIG. 10 is a diagram showing drawing steps of reducing the diameter of the diametrically small cylindrical portion of the thin can which is drawn at its bottom to form the diametrically small cylindrical portion in the second embodiment of the bottle-shaped can manufacturing method of the invention.

Figure 11:
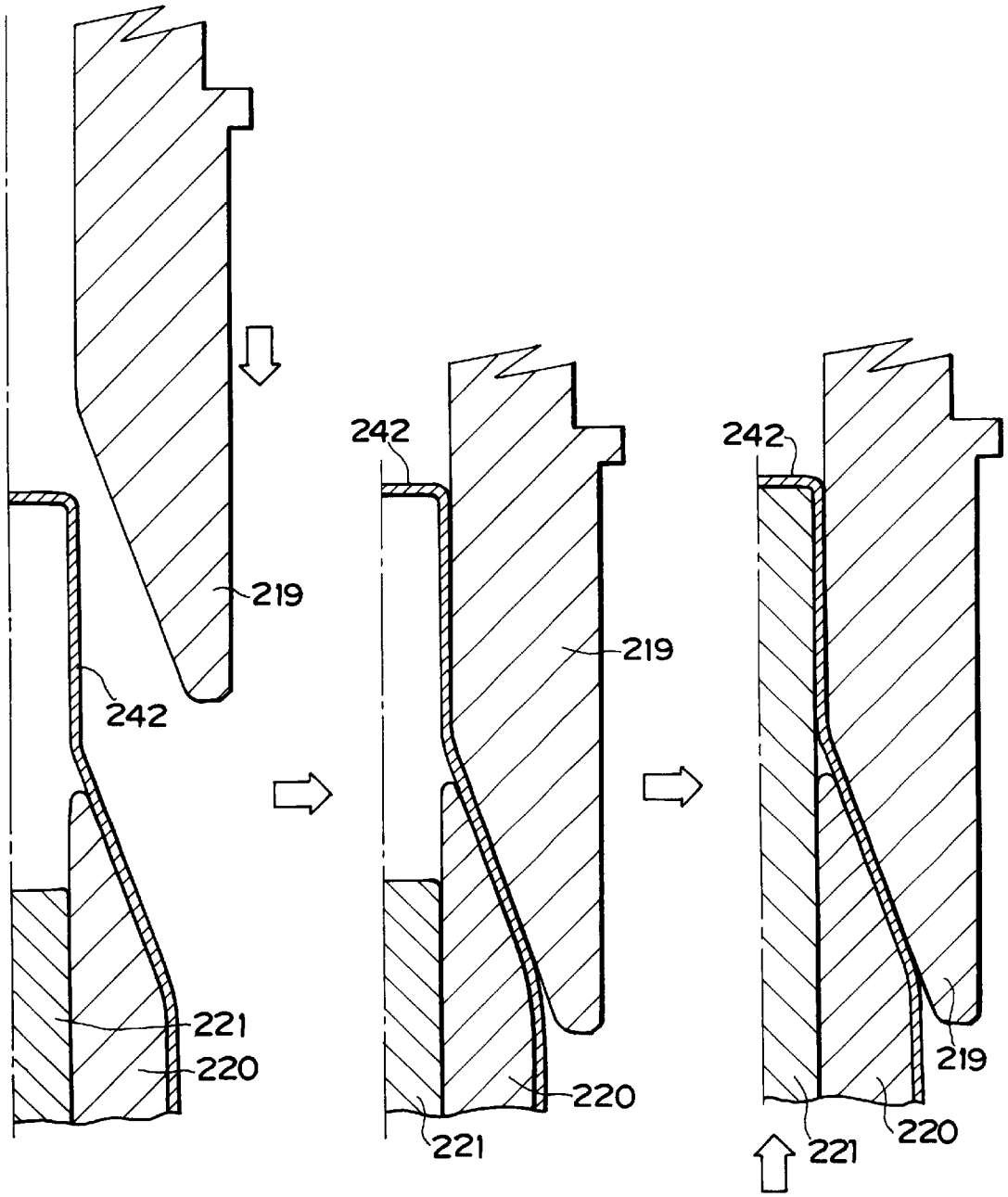
FIG. 11 is a view for explaining a shoulder portion reforming step of reforming the shoulder portion having one curved shoulder face, two shallow curved concave faces and one narrow convex portion between the two shallow curved concave faces, as formed at three drawing (or re-drawing) steps, into a shoulder portion having a slope of a straight longitudinal section, which shows a sectional view showing a portion in a state at a reforming staring time, a sectional view showing a portion in a state where the shoulder portion is pinched between a die and a pusher and a sectional view showing a portion in a state where a pulling force is applied by a punch.

Moreover, FIG. 11 is a diagram for explaining the shoulder portion reforming steps of reforming the shoulder portion, which has been drawn (or re-drawn) three times to form one curved shoulder face, two shallow curved concave faces and one narrow convex portion, but for the portion having the curved face left on the trunk side, into the shoulder portion having the slope of the straight longitudinal section.

The bottle-shaped can 201, as shown in FIG. 9, is provided at the lower end of a threaded neck portion 204, with a shoulder portion 203 having a substantially frusto-conical slope (that is, the bottle-shaped can shown in FIG. 9 has an inclined angle of the shoulder portion of about 20 degrees with respect to the axis of the can). The shoulder portion 203 is provided with a curved face at its joint portion to a cylindrical trunk portion 202 and has a substantially same length as that of the trunk portion 202. This cylindrical trunk portion 202 is necked in at its lower end portion, on which a bottom end 205 is seamed.

This bottle-shaped can 201 is mostly similar in shape to that of the first embodiment, excepting that the neck portion 204 is relatively long whereas the trunk portion 202 is relatively short and that the shoulder portion 203 is formed into the slope of the straight longitudinal section. Since the forming method is unchanged but for a portion, on the other hand, the portions which are not different will be simply touched by adding a numeral "200" to the reference numerals of the bottle-shaped can of the first embodiment, and the description is directed exclusively to the portions different from those of the first embodiment and to the forming method while omitting some portions.

The method for manufacturing this bottle-shaped can will be described in the following.

First of all, a bi-oriented film, which is formed of a resin containing the polybutylene terephthalate resin and polyethylene terephthalate resin at a mixing ratio of 60:40 to have a thickness of 20 micron meters, is thermally adhered on the two sides of an aluminum alloy sheet heated to 280° C. Immediately after this, the material is quenched to make the films of the mixture resin amorphous, thereby to manufacture the metallic sheet to be used as the blank for forming the bottomed cylindrical can.

The well-known lubricant is applied to the two sides of the metallic sheet laminated with the thermoplastic resin film of the above-specified resin or the like. Then, the blank is punched out and drawn into the cup shape. This cup is drawn/bent/stretched/ironed at its side wall portion. After this, the open end portion is trimmed to a predetermined length. These steps are identical to those shown in FIG. 2.

Here, the drawing/bending-extending (or stretching)/ironing steps of FIG. 2 are performed at three steps, at the third step of which the bottom corner portion of the can is preformed into the curved shoulder face 231 by employing a punch finished to have a curved face on the circumferential edge portion at its leading end. The curved shoulder face shape to be formed in this preforming is given a radius of curvature conforming to the slope to be formed on the shoulder portion.

The forming steps of the diametrically small cylindrical neck portion and the frusto-conical shoulder portion after the preforming of the curved shoulder face 231 are substantially identical to those shown in FIGS. 3 and 4. However, the shape of the shoulder portion, as reformed in FIG. 3, and the shapes of the shoulder portion, as shown in FIG. 4 showing the subsequent step of drawing the neck portion, are different from the shown ones.

The threading/curling step or the step after the neck portion 204 and the shoulder portion 203 were formed is absolutely identical to the steps of FIG. 5, excepting that the shape of the shoulder portion is different.

Now, the thin can, as having been preformed at its curved shoulder face, is drawn at its flat bottom into the bottomed cylindrical shape having a smaller diameter than that of the trunk, by employing a pair of unwrinkling tools (i.e., a die and a pusher) substantially identical to those shown in FIG. 6. At this drawing step, the preformed curved shoulder face is reformed into a portion of the diametrically small bottomed cylindrical portion and a portion of the can trunk below is reformed into the curved shoulder face without being wrinkled. The shape of an essential portion of the drawn can is shown in FIG. 10. The can, as having been drawn at its bottom at the first drawing step to form a diametrically small cylindrical portion 242, is formed to form a diametrically smaller bottomed cylindrical portion, as shown in FIG. 10, by employing a re-drawing die 214 to contact with the outer face of the diametrically small bottomed cylindrical portion, an unwrinkling pusher 215 to contact with the inner face of the diametrically small bottomed cylindrical portion and a re-drawing punch 216.

Here, the shape of the re-drawing die 214 to be employed is drastically different from that of the first embodiment. Specifically, the first embodiment has employed the die having tapered face of a substantially straight longitudinal section profiling a tangent line to an arcuate longitudinal section of a virtual curved face leading to the preformed curved shoulder face. Since the shoulder portion to be formed in this embodiment has the slope of the straight longitudinal section, however, the following disadvantages occur if the drawing working is performed by employing the die 214 having the same slope as that having the straight longitudinal section.

As the re-drawing working proceeds, more specifically, the slope (or curved shoulder face) 231 formed at the preceding step gradually comes closer to the re-drawing die 214. At the re-drawing stage, as shown in FIG. 10, the slope 231 formed at the preceding drawing step comes into contact with the substantially entire face of the die 214 so that the drawing working takes a drawing ratio substantially equal to D0/D2.

As a result, the drawing working exceeds the drawing limit even if the drawing ratio of D1/D2, as estimated for this drawing (or re-drawing) step, is selected to a surplus value of about 1.3 for the drawing limit, so that the slope portion for the shoulder portion is wrinkled.

In this embodiment, therefore, the leading end portion of the die 214 acting as the unwrinkling tool to contact with the outer face of the diametrically small bottomed cylindrical portion of the can, that is, the leading end portion of the die 214, which faces the pusher 215 having the tapered face of a substantially straight longitudinal section (and which has the tapered face of the substantially straight longitudinal section) is formed on its surface shape into the convex curved face having a gradient approximating the slope of the shoulder portion to be formed, so that the slope (or the curved shoulder face) 231 formed at the preceding step may be prevented from contacting with the entire face of the die 214.

Thus, it is an outstanding characteristic of this embodiment that the slope 231 to be brought to the die 214 by the pulling force from the bottomed cylindrical portion is pulled into the clearance between the die 214 and the pusher 215 while contacting at its small area portion with the die 214 and receiving the frictional resistance. For this function of the die 214 and the pusher 215, in this embodiment, it is necessary to determine the size of the die 214 and the pusher 215 so that the lower end of the convex curved face of the die 214 is positioned on the outside of a lower end of the tapered face of the pusher 215 in a radial direction with respect to the can axis.

As the drawing working proceeds, the re-drawing die 214 of this embodiment gradually comes into contact at the leading end portion of its convex curved face with the diametrically small bottomed cylindrical portion to the slope of the can, as clearly seen from FIG. 10, but does not come into contact with the arcuate longitudinal section, i.e., the entire convex curved face until a boundary line 243 between the lower end of the diametrically small bottomed cylindrical portion 242 and the upper end of the curved shoulder face 231, as formed at the preceding step, and its adjacent curved shoulder face portion are pulled into the clearance between the die 214 and the pusher 215 (as referred to FIG. 10).

At the steps shown in FIG. 10, the boundary line 243 and its adjacent curved shoulder face portion are stretched, and the convex curved face shape of the die 214 is transferred thereto, so that they are formed into a shallow concave curved face shape.

The formed bottomed cylindrical portion, as has been re-drawn from the diametrically small bottomed cylindrical portion at the steps of FIG. 10, is re-drawn once more under similar conditions into a smaller diameter sequentially at the steps shown in FIG. 10.

As a result, the thin can is provided on its bottom side with the diametrically small bottomed cylindrical portion and the shoulder portion in which two shallow concave curved faces are jointed through one narrow convex portion and which has the curved shoulder face 231.

After this, by employing a reforming die 219 and a reforming pusher 220 having tapered faces of an inclined angle of about 20 degrees, and a reforming punch 221, as shown in FIG. 11, the shoulder portion is pinched in its entirety excepting the curved shoulder face 231 between the die 219 and the pusher 220, and the punch 221 is slightly moved forward to apply the pushing force to the bottom of the bottomed cylindrical portion 242 so that the pulling force is applied from the bottomed cylindrical portion to the shoulder portion to stretch the two shallow concave curved faces and the one narrow convex portion of the shoulder portion thereby to reform the shoulder portion to have a slope of about 20 degrees.

In this embodiment, too, if the ratio of the diameter of the neck portion (i.e., the maximum external diameter portion of the neck portion) to be formed and the trunk diameter of the can is one half or more, the steps of FIG. 10 need not be repeated because the neck portion having the predetermined diameter is obtained at the two drawing steps.

Figure 12:
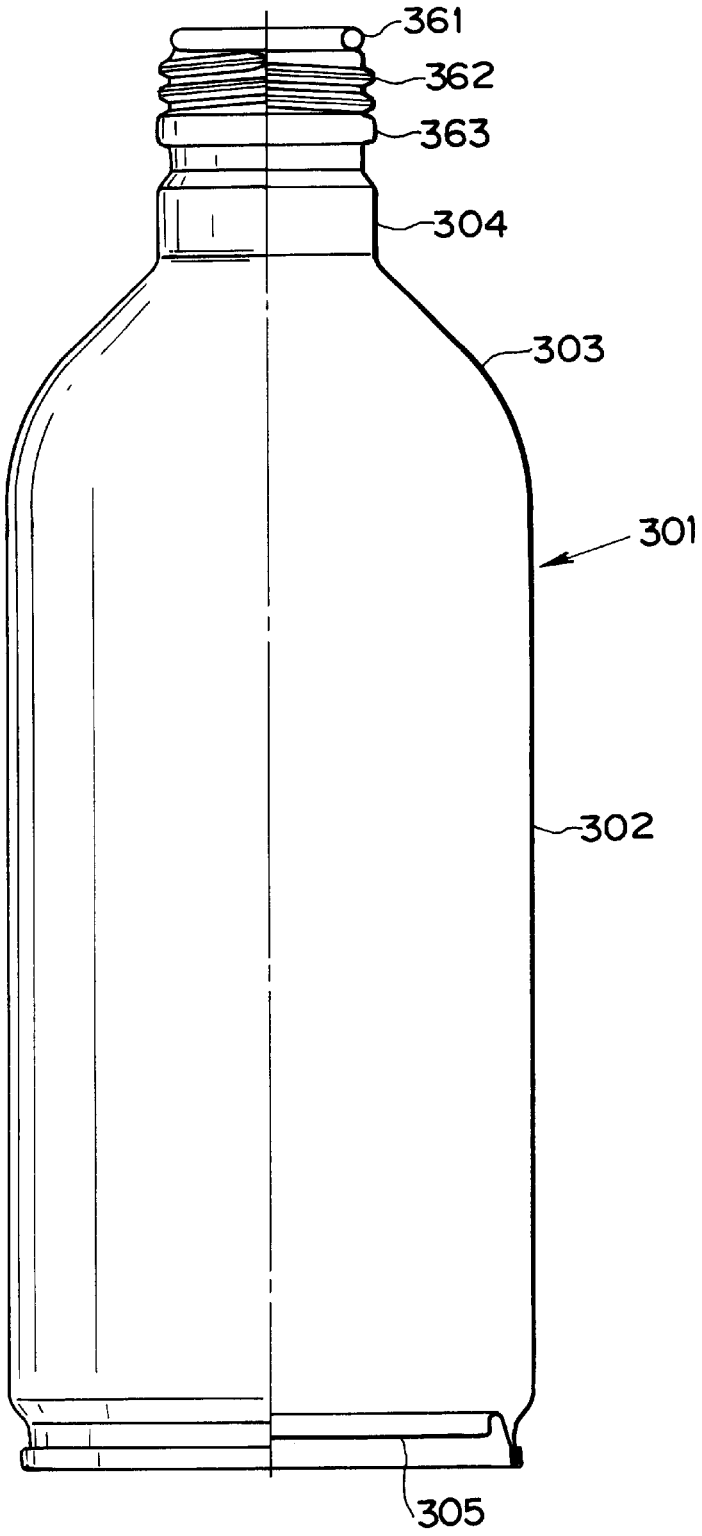
FIG. 12 is a partially sectional side elevation showing still another example of a bottle-shaped can manufactured by a method of the invention with its right-hand half being in section.

Now, FIG. 12 shows a bottle-shaped can 301 which is manufactured by the method of a third embodiment such that its shoulder portion is formed to have a slope of a straight longitudinal section and an angle of about 45 degrees with respect to the axis of the can.

Figure 13:
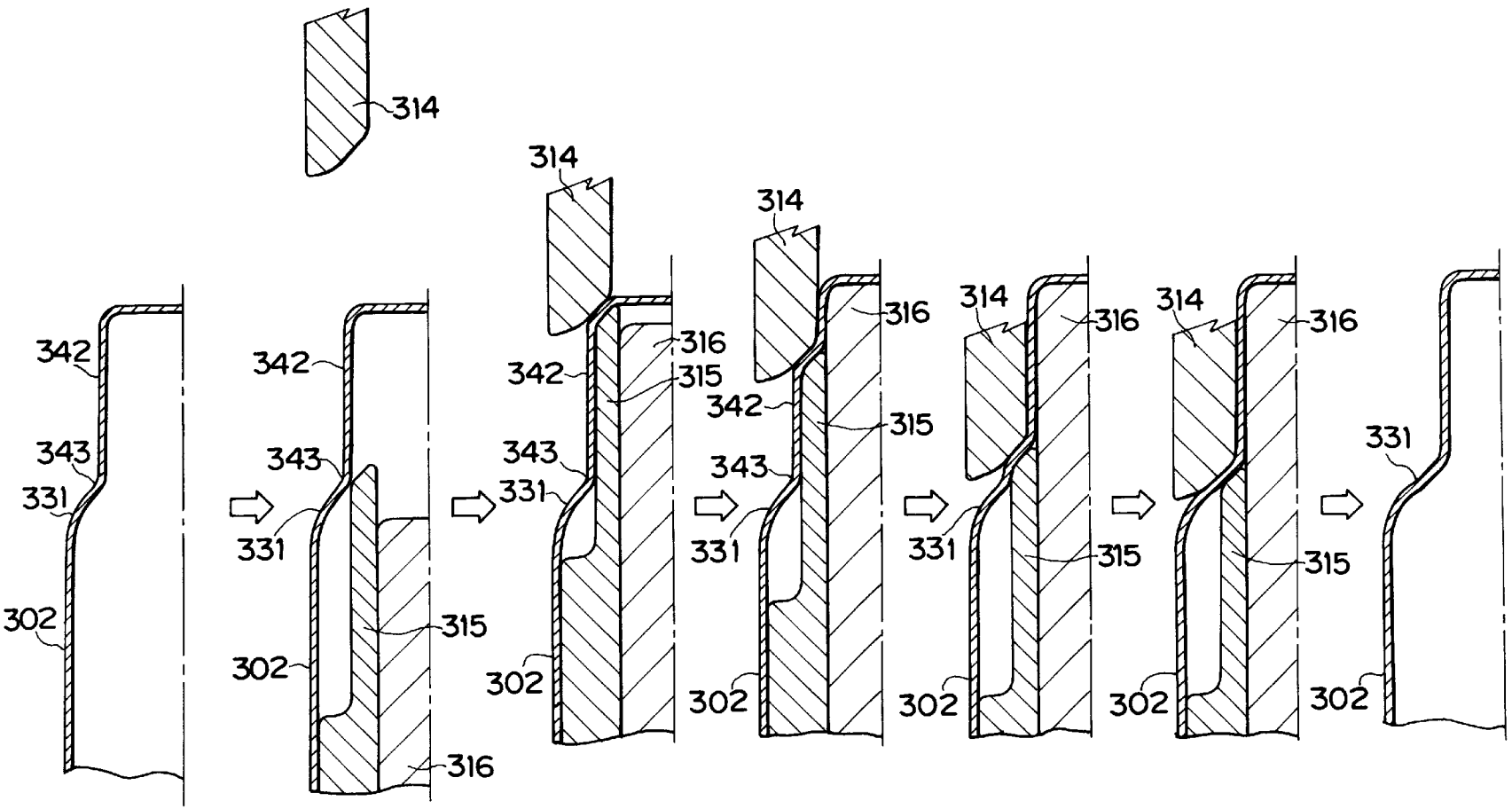
FIG. 13 is a view showing steps, in a third embodiment of the method for manufacturing the bottle-shaped can of the invention, at which a diametrically small bottomed cylindrical portion formed by the drawing is re-drawn, which shows a sectional view showing a portion of a shape of the diametrically small cylindrical portion before worked, a sectional view showing a portion in a state at a re-drawing starting time, a sectional view showing a portion in a state where the drawing of the diametrically small cylindrical portion is started, a sectional view showing a portion in a state where the drawing proceeds to an intermediate portion of the diametrically small cylindrical portion, a sectional view showing a portion in a state where the drawing proceeds to a root portion of the diametrically small cylindrical portion, a sectional view showing a portion in a state where a drawn diametrically small cylindrical portion is stretched to the side of the shoulder portion and a sectional view showing a shape of the diametrically small cylindrical portion which is finished with the drawing.

On the other hand, FIG. 13 shows such one of the steps of manufacturing the bottle-shaped can 301 of the third embodiment as re-draws the diametrically small bottomed cylindrical portion which is drawn after the bottom corner portion of the thin can was preformed into the curved shoulder face.

This bottle-shaped can 301 is different only in the shoulder portion shape from the bottle-shaped can (having the shoulder portion of the domed curved face shape), as exemplified in the first embodiment. The re-drawing steps of the diametrically small cylindrical portion are substantially identical to those of the second embodiment, and their description will be simplified or omitted by adding a numeral "100" to the reference numerals designating the same parts or portions as those of the second embodiment.

Of the manufacture steps of the bottle-shaped can 301, the steps of forming the thin can is identical to those of FIG. 2 of the first embodiment. Of the steps of drawing the bottom portion of the can into the shoulder portion having the diametrically small neck portion and the slope, the step of preforming the curved shoulder face and the drawing step using the paired unwrinkling tools having the same curved face as the curved shoulder face shown in FIG. 6 are identical to those of the first embodiment.

Of the manufacture steps of this bottle-shaped can, on the other hand, the second drawing (or re-drawing) step (i.e., the second diametrically small cylindrical portion forming step) and its repeating step (i.e., the second diametrically small cylindrical portion formation repeating step) are substantially identical to those of the second embodiment, as shown in FIG. 10, but are shown in FIG. 13 to make clear.

In the state where the bottom corner portion of a diametrically small bottomed cylindrical portion 342 is unwrinkled between a re-drawing die 314 and an unwrinkling pusher 315, a re-drawing punch 316 is moved forward to the re-drawing die 314. Then, the portion of a boundary line 343 between the diametrically small bottomed cylindrical portion 342 and a lower curved shoulder face 331, as formed at the preceding step, and the curved shoulder face portion in the vicinity of the boundary line 343 are brought closer to the convex curved face of the die 314 (as shown in FIG. 13) so that they come into contact with the convex curved face of the die 314. Next, the portion of the boundary line 343 and the its adjacent curved shoulder face portion are pulled, while receiving the frictional resistance from the convex curved face, to advance into the clearance between the slope of the die 314 and the slope of the pusher 315 so that the portion of the boundary line 343 is substantially flattened in the advancing course. When the re-drawing working is stopped, as shown in FIG. 13, the convex curved face of the die 314 is transferred to the upper portion of the curved shoulder face so that the upper portion is formed into the concave curved face shape. In the present embodiment, a lower end of the convex curved face of the die 314 is positioned on the greatly outer side of the lower end of the tapered face of the pusher 315, in a radial direction with respect to the can axis.

On the other hand, the step of reforming the shoulder portion of the bottle-shaped can of this embodiment is identical to that of the second embodiment shown in FIG. 11.

Moreover, the step of drawing the upper half of the diametrically small bottomed cylindrical portion, the step of further drawing the upper half of the drawn upper half of the bottomed cylindrical portion and the step of trimming away the upper end portion of the twice drawn portion are identical to those of the first embodiment, as shown in FIG. 4, except the difference in the shape of the shoulder portion. The curling step, the threading step and the beading step are also identical to those of the first embodiment, as shown in FIG. 5, except the difference in the shape of the shoulder portion.

Although the invention has been described in connection with several embodiments on the method for manufacturing the bottle-shaped can, it should not be limited to those embodiments.

For example, the metallic sheet for the material should not be limited to the aluminum alloy sheet but could employ a surface-treated steel sheet, as subjected to various metal plating treatments or conversion treatments employed for the can manufactures, such as a lightly tin coated steel sheet, a nickel plated steel sheet, an electrolytic chromate treated steel sheet (TFS-CT), a galvanized steel sheet or other sheet.

On the other hand, the thermoplastic resin film to be used can be suitably exemplified by a copolymer of polyethylene terephthalate/isophthalate, a copolymer of polyethylene terephthalate/adipate, a copolymer of polybutylene terephthalate/isophthalate, a copolymer of polyethylene naphthalate/terephthalate, polybutylene terephthalate, polyethylene naphthalate, polyethylene terephthalate, polypropylene, a copolymer of ethylene-propylene or acidic-modified polypropylene, either solely or by mixture, and a film made of these resins may be given a multi-layered construction.

Moreover, a metallic sheet, which is not laminated with a synthetic resin film such as the thermoplastic resin film, can be used as the material and coated after the can is formed.

Still moreover, the method of forming the bottomed cylindrical can may be practiced by performing at least one step (or re-drawing step) of bending/extending (or stretching) the cup, as punched out from the metallic sheet and drawn thereinto, while re-drawing it to thin the trunk wall. The method may also be practiced by performing at least one step of bending/extending and ironing the cup, as formed by the drawing, while re-drawing it to thin the trunk wall. At the re-drawing time, moreover, the cup may be bent and extended and then be ironed. Thus, it is needless to say that the method can be suitably modified.

Even when the curved shoulder face is to be preformed at the thin can forming step, on the other hand, the re-drawing punch is formed at the outer circumferential edge of its leading end into a curved face of a relatively large radius of curvature. At the re-drawing time, the cup is re-drawn to have a slightly larger curved shoulder face than the curved face of the final shape. The punch for the subsequent ironing working or for the stretching and ironing workings is formed at the outer circumferential edge of its leading end into a curved face of a smaller radius of curvature than that of the punch for the re-drawing working. At the ironing working or at the stretching and ironing workings, the bottom corner portion of the thin can is preformed into the curved shoulder face of a predetermined radius of curvature. The preforming working could be performed at these many steps.

In the foregoing first embodiment, still moreover, the bottomed cylindrical can having an external diameter of 65.9 mm is drawn three times at its bottom portion to form a neck portion of an external diameter of 28.0 mm (in the maximum external diameter portion). If the external diameter of the neck portion is set at a numerical value of about 38.0 mm, for example, the drawing workings can be reduced two times.

In short, it is possible to omit the repetition of the second diametrically small cylindrical portion forming step, as shown in FIG. 3. By reducing the second diametrically small cylindrical portion forming step to one time, it is possible to lower the manufacture cost in accordance with the reduction in the number of steps of manufacturing the bottle-shaped can.

Likewise, the number of the re-drawing steps can be reduced in the first embodiment and the second embodiment, too, if the diameter of the neck portion is enlarged.

INDUSTRIAL APPLICABILITY

The present invention relates to a method for manufacturing a bottle-shaped can from a metallic sheet so that it is applicable in the industrial field of manufacturing containers for various drinks such as beer or carbonated beverages. The metallic can can be re-sealed with a cap and collected as an used general metallic can, thereby to broaden the utility in the field of manufacturing a beverage can.

What is claimed is:

1. A bottle-shaped can manufacturing method for forming a shoulder portion having a slope and a diametrically small cylindrical neck portion integrally by further working a bottom side of a bottomed cylindrical can which is formed thinner at its trunk wall than at its bottom wall by drawing a metallic sheet having a thickness of 0.1 to 0.4 mm and by executing a thinning working of at least one of a bending/extending working and an ironing working, comprising:

a step of preforming a bottom corner portion of said can into a curved shoulder face having an arcuate longitudinal section;

a first diametrically small cylindrical portion forming step of drawing the bottom of said can, with the curved shoulder face of said bottom corner portion being unwrinkled, into a diametrically smaller bottomed cylindrical shape than the trunk portion by using an unwrinkling pusher having a curved face shape of said shoulder portion on an outer face shape of its leading end portion, a drawing die having a curved face shape of said shoulder portion on an inner face shape of its leading end portion, and a drawing punch;

a second diametrically small cylindrical portion forming step of drawing the bottomed cylindrical portion drawn from the can bottom into a diametrically smaller bottomed cylindrical shape, with said bottom corner portion being unwrinkled by surfaces of a tool including an unwrinkling pusher having at its leading end portion a tapered face having a substantially straight longitudinal section profiling a tangent line to an arcuate longitudinal section of a virtual curved face leading to said preformed curved shoulder face, a re-drawing die having a tapered face of a straight longitudinal section profiling a tangent line to an arcuate longitudinal section of a virtual curved face leading to said curved shoulder face at its portion to face at least said tapered face of said pusher, and a re-drawing punch; and a shoulder portion reforming step of pushing and extending the shoulder portion, which is formed by said first diametrically small cylindrical portion forming step and said second diametrically small cylindrical portion forming step into a smooth slope leading to the curved shoulder face on the trunk side, after a diameter of the bottomed cylindrical portion formed by executing the drawing working of said second diametrically small cylindrical portion forming step once or two or more times becomes substantially equal to a diameter of said neck portion.

2. A bottle-shaped can manufacturing method according to claim 1, wherein said second diametrically small cylindrical portion forming step includes: a step of re-drawing said diametrically small cylindrical portion, with said bottom corner portion of said drawn diametrically small cylindrical portion being unwrinkled, by using an unwrinkling pusher having at its leading end portion a tapered face having a substantially straight longitudinal section profiling a tangent line to an arcuate longitudinal section of a virtual curved face leading to said curved shoulder face, a re-drawing die having at its leading end portion such a tapered face having the shape of a straight longitudinal section profiling a tangent line to an arcuate longitudinal section of a virtual curved face leading to said curved shoulder face as has a larger external diameter than an external diameter of the tapered face of the pusher, and a re-drawing punch; and a step of continuing the re-drawing working till a boundary line between said diametrically small cylindrical portion and the slope and the slope portion in the vicinity of said boundary line come into contact with the tapered face of said pusher and the tapered face of said die.

3. A bottle-shaped can manufacturing method according to claim 2, wherein the tool to be used at said shoulder portion re-drawing step includes a pair of forming tools having a surface shape of a virtual curved face extending from said curved shoulder face, and wherein the method further includes a step of reforming said shoulder portion in its entirety into a smooth curved face of a domed longitudinal section leading to the curved shoulder face, by pinching most of said shoulder portion between said paired forming tools to push and extend the same.

4. A bottle-shaped can manufacturing method according to claim 1, wherein said second diametrically small cylindrical portion forming step includes: a step of re-drawing said diametrically small cylindrical portion, with said bottom corner portion of said drawn diametrically small cylindrical portion being unwrinkled, by using an unwrinkling pusher having at its leading end portion a slope having a substantially straight longitudinal section profiling a tangent line to an arcuate longitudinal section of a virtual curved face leading to said curved shoulder face, a re-drawing die having at its portion to face said slope of said pusher a slope having a shape of a substantially straight longitudinal section profiling a tangent line to an arcuate longitudinal section of a virtual curved face leading to said curved shoulder face, and at its portion on the leading end side from said slope a convex curved face of an arcuate longitudinal section having a larger external diameter than an external diameter of the slope of said pusher, and a re-drawing punch; and a step of continuing the drawing working till the boundary line between said diametrically small cylindrical portion and the slope and the slope portion in the vicinity of said boundary line come into contact with the slope of said pusher and the slope of said die.

5. A bottle-shaped can manufacturing method according to claim 4, wherein the slope of said unwrinkling pusher, and the slope and the convex curved face of said re-drawing die, as used at the second or later step when said second diametrically small cylindrical portion forming step is repeated two or more times, are individually and substantially identical to the slope of said pusher and the slope and the convex curved face of said die, as used at the first step.

6. A bottle-shaped can manufacturing method according to claim 4, wherein the tool to be used at said shoulder portion re-drawing step includes: a pair of forming tools having a surface shape of the tapered face of a straight longitudinal section profiling a tangent line to a virtual curved face leading from said curved shoulder face; and a punch to be inserted into said diametrically small cylindrical portion, and wherein the method further includes a step of reforming most of said shoulder portion into a smooth slope continuing in a straight longitudinal section shape leading to the curved shoulder face by pinching said shoulder portion in its entirety between said paired forming tools and by pushing the bottom portion of said diametrically small cylindrical portion by said punch, to apply a pulling force toward said diametrically small cylindrical portion to said shoulder portion thereby to push and extend said shoulder portion.

7. A bottle-shaped can manufacturing method according to claim 1, further comprising:

a step of forming a curved shoulder face on the bottom corner portion of said can by preforming said bottom corner portion by using a punch having a curved face on the outer circumference of its leading end portion after said bottomed cylindrical can was formed by said drawing working and said thinning working and before said bottom side of said can is drawn.

8. A bottle-shaped can manufacturing method according to claim 1, wherein said curved shoulder face is preformed on the bottom corner portion of said can at the final forming step of said bottomed cylindrical can by using a punch having a curved face at the outer circumference of its leading end portion, as the punch to be used at the final working step of forming said bottomed cylindrical can which is made thinner at its trunk wall than at its bottom wall by the drawing working and by the thinning working.

9. A bottle-shaped can manufacturing method according to claim 1, wherein said metallic sheet includes a metallic sheet prepared by laminating a thermoplastic resin film on an aluminum alloy sheet in advance.

10. A bottle-shaped can manufacturing method according to claim 1, wherein said metallic sheet includes a metallic sheet prepared by laminating a thermoplastic resin film on a surface-treated steel sheet in advance.

11. A bottle-shaped can manufacturing method according to claim 1, wherein said bottomed cylindrical can is thinned so that a thickness of a side wall in the vicinity of its bottom is less than a thickness of the metallic sheet before formed, but is 60% or more of the thickness of said metallic sheet.

12. A forming tool for use in the manufacture of a bottle-shaped can which is made of a bottomed cylindrical can of a metallic sheet and having a bottom corner portion formed into an arcuate curved shoulder face, by working a bottom side of said can to integrally form a shoulder portion having a slope and a diametrically small cylindrical neck portion, comprising:

a drawing die having an inner face shape of its leading end portion identical to a curved face shape of an outer face of said shoulder portion and adapted to be brought into abutment against the outer face of said shoulder portion;

a first unwrinkling pusher having an outer face shape of its leading end portion identical to a curved face shape of an inner face of said shoulder portion and adapted to be brought into abutment against the inner face of said shoulder portion; and a drawing punch for pushing said can bottom at a portion closer to the center side than the bottom corner portion which is pinched by said die and said pusher relatively from the inner face to the outer face, to form a bottomed cylindrical portion.

13. A forming tool according to claim 12, further comprising:

a second unwrinkling pusher having at its leading end portion a tapered face of a substantially straight longitudinal section profiling a tangent line to an arcuate section of the curved face of said shoulder portion preformed;

a first re-drawing die having at a portion to face at least said tapered face of said second unwrinkling pusher such a tapered face of a straight longitudinal section profiling a tangent line to an arcuate longitudinal section of the curved face of said shoulder portion, as has a larger external diameter than that of the tapered face of said second unwrinkling pusher; and a first re-drawing punch for forming said bottomed cylindrical portion into a diametrically smaller cylindrical portion, by pushing said bottomed cylindrical portion relatively from its inner side to its outer side in the axial direction, with the corner portion of said can bottom being unwrinkled by said second unwrinkling pusher and said first re-drawing die.

14. A forming tool according to claim 13, further comprising:

a third unwrinkling pusher having at its leading end portion a tapered face of a substantially straight longitudinal section profiling a tangent line to an arcuate longitudinal section of a virtual curved face leading to the curved face of said shoulder portion;

a second re-drawing die having at its leading end portion such a tapered face of a substantially straight longitudinal section profiling a tangent line to an arcuate longitudinal section of a virtual curved face leading to the curved face of said shoulder portion as has a larger external diameter than an external diameter of the tapered face of said third unwrinkling pusher; and a second re-drawing punch for re-drawing said diametrically small cylindrical portion by pushing said diametrically small cylindrical portion relatively from its inner face side to its outer face side in the axial direction, with the bottom corner portion of said diametrically small cylindrical portion being unwrinkled by said third unwrinkling pusher and said second re-drawing die.

15. A forming tool according to claim 12, further comprising:

a second unwrinkling pusher having at its leading end portion a slope of a substantially straight longitudinal section profiling a tangent line to an arcuate longitudinal section of a virtual curved face leading to the curved face of said shoulder portion;

a first re-drawing die having, at its portion to face said slope of said second unwrinkling pusher a slope of a substantially straight longitudinal section profiling a tangent line to an arcuate longitudinal section of a virtual curved face leading to the curved face of said shoulder portion, and at its portion on the leading end side from said slope a convex curved face having a larger external diameter than an external diameter of the slope of said second unwrinkling pusher; and a first re-drawing punch for re-drawing said diametrically small cylindrical portion into a diametrically smaller cylindrical portion by pushing said bottomed cylindrical portion relatively from its inner face side to its outer face side in the axial direction, with the bottom corner portion of said bottomed cylindrical portion being unwrinkled by said second unwrinkling pusher and said first re-drawing die.

16. A forming tool according to claim 15, further comprising:

a third unwrinkling pusher having at its leading end portion a slope of a straight longitudinal section profiling a tangent line to an arcuate longitudinal section of a virtual curved face leading to the curved face of said shoulder portion;

a second re-drawing die having at its portion to face said slope of said third unwrinkling pusher a slope of a substantially straight longitudinal section profiling a tangent line to an arcuate longitudinal section of a virtual curved face leading to the curved face of the shoulder portion, and at its portion on the leading end side from said slope such a convex curved face of an arcuate longitudinal section as has a larger external diameter than an external diameter of the slope of the third unwrinkling pusher; and a second re-drawing punch for re-drawing said diametrically small cylindrical portion by pushing it relatively from its inner face side to its outer face side in the axial direction, with the bottom corner portion of said diametrically small cylindrical portion being unwrinkled by said third unwrinkling pusher and said second re-drawing die.

* * * * *